US008793009B2

(12) United States Patent
Ihira

(10) Patent No.: US 8,793,009 B2
(45) Date of Patent: Jul. 29, 2014

(54) DATA GENERATOR, COMPUTER READABLE RECORDING MEDIUM, AND SEWING MACHINE

(75) Inventor: Yuki Ihira, Kakamigahara (JP)

(73) Assignee: Brother Kogyo Kabushiki Kaisha, Nagoya (JP)

( * ) Notice: Subject to any disclaimer, the term of this patent is extended or adjusted under 35 U.S.C. 154(b) by 109 days.

(21) Appl. No.: 13/561,573

(22) Filed: Jul. 30, 2012

(65) Prior Publication Data

US 2013/0035779 A1 Feb. 7, 2013

(30) Foreign Application Priority Data

Aug. 3, 2011 (JP) ..... 2011-170143

(51) Int. Cl.
*D05C 5/02* (2006.01)
*D05B 19/10* (2006.01)
*D05C 5/04* (2006.01)

(52) U.S. Cl.
CPC . *D05C 5/04* (2013.01); *D05B 19/10* (2013.01)
USPC ..... 700/138; 112/470.01

(58) Field of Classification Search
USPC ..... 700/136–138; 112/470.01, 470.04, 112/470.06, 475.18, 475.19
See application file for complete search history.

(56) References Cited

U.S. PATENT DOCUMENTS 4,869,188 A 9/1989 Hyodo
5,740,057 A * 4/1998 Futamura ..... 700/138
5,751,583 A * 5/1998 Kyuno et al. ..... 700/137
5,954,004 A 9/1999 Futamura
6,012,402 A 1/2000 Sekine
6,304,793 B1 10/2001 Komiya et al.
6,321,670 B1 11/2001 Tomita
6,324,441 B1 * 11/2001 Yamada ..... 700/138
RE38,718 E 3/2005 Futamura
6,980,877 B1 * 12/2005 Hagino et al. ..... 700/138
7,503,271 B2 * 3/2009 Hayakawa ..... 112/470.01
7,542,822 B2 6/2009 Kawaguchi et al.
2007/0199492 A1 8/2007 Ishii

FOREIGN PATENT DOCUMENTS

JP A-11-057262 3/1999
JP B2-2874674 3/1999

OTHER PUBLICATIONS

"Overview of Electric Quilt 6 Software," http://www.electricquilt.com/Shop/EQ6/EQ6.asp, Retrieved on Oct. 18, 2010, 6 pages, The Electric Quilt Company.
"User's Guide to Electric Quilt 6 Software," http://www.rasenkaidan.com, Retrieved on Oct. 18, 2010, 13 pages, Rasenkaidan.

(Continued)

*Primary Examiner* — Nathan Durham
(74) *Attorney, Agent, or Firm* — Oliff PLC

(57) ABSTRACT

A data generator includes a memory and a processor. The memory may store a plurality of predetermined colors. The processor may control the data generator to determine a characteristic of a color-based pattern portion, and to assign a color for each of the plurality of color-based pattern portions based on the characteristic. The plurality of the color-based pattern portions may be included in an embroidery pattern. The assigned color may be selected randomly from the plurality of predetermined colors stored in the memory and used as thread color data.

13 Claims, 17 Drawing Sheets

(56) References Cited

OTHER PUBLICATIONS

"User's Guide to Adobe Illustrator CS4," http://help.adobe.com/en_US/Illustrator/14.0/WS8F5038A7-E2BE-402f-B15F-850702A681C2a.html, Retrieved on Apr. 2, 2012, 8 pages (with translation).

U.S. Appl. No. 13/569,759, filed Aug. 8, 2012 in the name of Ryutaro Maki.

U.S. Appl. No. 13/361,401, filed Jan. 1, 2012 in the name of Ryutaro Maki et al.

Dec. 20, 2013 Office Action issued in U.S. Appl. No. 13/361,401.

Jan. 17, 2014 Notice of Allowance issued in U.S. Appl. No. 13/569,759.

* cited by examiner

| EMBROIDERY DATA | |
|---|---|
| FIRST PATTERN PORTION DATA | PATTERN 1 PURPLE |
| | Xa0,Ya0 |
| | Xa1,Ya1 |
| | Xa2,Ya2 |
| | ⋮ |
| | XaN,YaN |
| SECOND PATTERN PORTION DATA | PATTERN 2 ROSE |
| | Xb0,Yb0 |
| | Xb1,Yb1 |
| | Xb2,Yb2 |
| | ⋮ |
| | XbN,YbN |
| ⋮ | ⋮ |
| i-TH PATTERN PORTION DATA | PATTERN i MAGENTA |
| | Xc0,Yc0 |
| | Xc1,Yc1 |
| | Xc2,Yc2 |
| | ⋮ |
| | XcN,YcN |
| ⋮ | ⋮ |
| x-TH PATTERN PORTION DATA | PATTERN x MAGENTA |
| | Xn0,Yn0 |
| | Xn1,Yn1 |
| | Xn2,Yn2 |
| | ⋮ |
| | XnN,YnN |

FIG. 4

| VALUE [%] OF HSV SATURATIONS | CONTRASTING DENSITY LEVEL LV |
|---|---|
| 0 ~ 10 | 1 |
| 10 ~ 20 | 2 |
| 20 ~ 30 | 3 |
| 30 ~ 40 | 4 |
| 40 ~ 50 | 5 |
| 50 ~ 60 | 6 |
| 60 ~ 70 | 7 |
| 70 ~ 80 | 8 |
| 80 ~ 90 | 9 |
| ABOVE 90 AND NOT MORE THAN 100 | 10 |

FIG.8

| VALUE [%] OF HSV SATURATIONS | CONTRASTING DENSITY LEVEL LV |
|---|---|
| $0 \sim U_S \ (=\frac{S}{X})$ | 1 |
| $U_S \sim 2U_S$ | 2 |
| $2U_S \sim 3U_S$ | 3 |
| ⋮ | ⋮ |
| $(i-1)U_S \sim iU_S$ | i |
| $iU_S \sim (i+1)U_S$ | i+1 |
| ⋮ | ⋮ |
| $(x-1)U_S \sim 100$ | x |

FIG.10

DATA GENERATOR, COMPUTER READABLE RECORDING MEDIUM, AND SEWING MACHINE

FIELD OF THE INVENTION

The disclosure relates to a data generator that may generate embroidery data of an embroidery pattern including a plurality of color-based pattern portions, a computer readable recording medium storing a program which generates data for embroidery, and a sewing machine that may sew the embroidery pattern based on the embroidery data.

DESCRIPTION OF RELATED ART

Conventionally, sewing machines, which sew the embroidery pattern based on the embroidery data, have been known. For the sewing machines, the embroidery data may be stored in storage devise in the sewing machines or external storage devise such as ROM (Read Only Memory) cards or flexible disks. Users may select a desirable embroidery pattern from a plurality of embroidery patterns. The sewing machines load the selected embroidery data to stitch the embroidery pattern to a fabric.

The embroidery pattern includes a plurality of color-based pattern portions. The embroidery data of the embroidery pattern includes thread color data which identify a color of the color-based pattern portion. Each of the plurality of color-based pattern portions is sewn by the thread color which is predetermined as the thread color data. If a color of each of the plurality of color-based pattern portions is analogous to a color of the fabric, it would be difficult to distinguish the color-based pattern portion from the fabric. Specifically, in the case that a embroidery pattern of a flower is sewn into a fabric with the same color as that of the color-based pattern portion of a petal of the flower, it would be difficult to distinguish the petal from the fabric. Thus, the embroidery pattern would be strange because of the lack of the petal.

Some data generators may store coloration data which represent combinations of preferable colors. The data generators may set a color of the thread color data of the color-based pattern portion based on the coloration data and the fabric data which represent a color of the fabric. The data generators may determine the color-based pattern portion in the color of the embroidery pattern unambiguously based on the color of the fabric and the coloration data. Some user may prefer to sew each of the plurality of color-based pattern portions with a preferable color or a strange color rather than with a predetermined color. However, setting a color of the embroidery pattern preferably would be troublesome because it is required to load data of the color-based pattern portion and to confirm and designate corresponding thread color data.

SUMMARY

The disclosure may provide a data generator, a non-transitory computer readable recording medium storing computer readable instructions, and a sewing machine that may set a color of the embroidery pattern easily and may obtain various color patterns corresponding to a characteristic of the embroidery pattern.

A data generator includes a memory and a processor. The memory may store a plurality of predetermined colors. The processor may control the data generator to determine a characteristic of a color-based pattern portion, and to assign a color for each of the plurality of color-based pattern portions based on the characteristics. The plurality of the color-based pattern portions may be included in an embroidery pattern. The assigned color may be selected randomly from the plurality of predetermined colors stored in the memory and used as thread color data.

BRIEF DESCRIPTION OF THE DRAWINGS

FIG. 4 is a view showing an example of embroidery data;

FIG. 8 is a view showing a table indicating contrasting density levels;

FIG. 10 is a view similar to FIG. 8, showing a second example;

DETAILED DESCRIPTION

Figure 1:
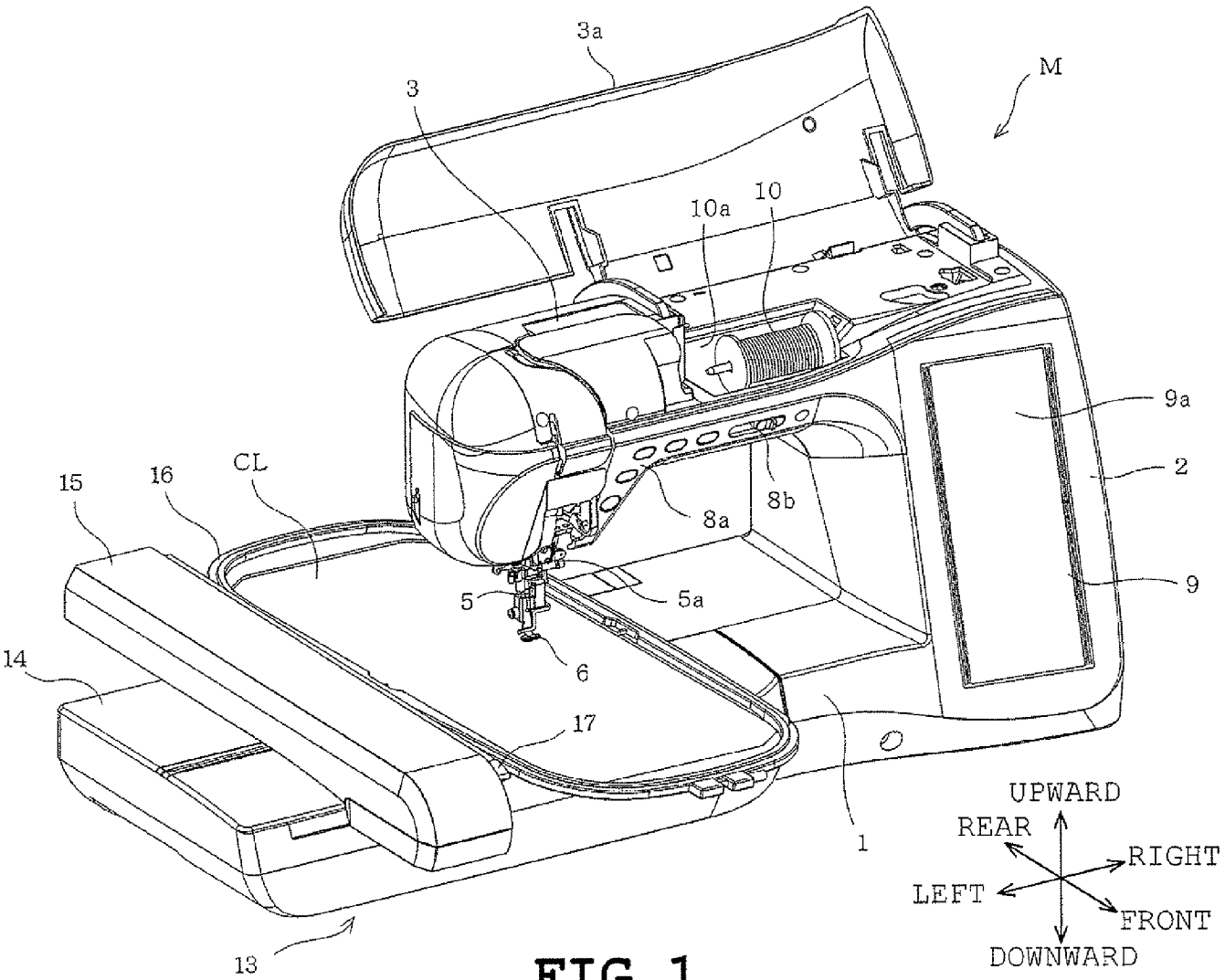
FIG. 1 is a perspective view of the sewing machine according to a first example.

A first example of household sewing machine (hereinafter, "sewing machine M") will be described with reference to FIGS. 1 to 9. Referring to FIG. 1, the sewing machine M includes a bed 1 extending in a right-left direction, a pillar 2 standing from a right end of the bed 1, and an arm 3 extending leftward from an upper part of the pillar 2, all of which are formed integrally with one another. The arm 3 houses a sewing machine shaft (not shown) extending in the right-left direction and a sewing machine motor 4 (see FIG. 2) which rotates the machine shaft. The side where the user is located relative to the sewing machine M will be referred to as "front" and the side opposed to the front will be referred to as "rear." The side where the pillar 2 is located will be referred to as "right side" and the side opposed to the right side will be referred to as "left side."

The arm 3 has a distal end on which are mounted a needle bar 5*a* attached with a needle 5 and a presser bar (not shown) provided with a presser foot 6. The arm 3 also houses a needle bar driving mechanism which moves the needle bar upward and downward based on rotation of the machine shaft and a needle bar swinging mechanism which swings the needle bar in a direction (the right-left direction) perpendicular to a cloth feed direction. The arm 3 further houses a needle thread take-up driving mechanism which moves a needle thread take-up (not shown) upward and downward in synchronization with the upward and downward movement of the needle bar, a presser bar driving mechanism which moves the presser bar upward and downward, and the like.

The arm 3 is provided with a cover 3*a* which is pivotally mounted thereon so as to open and close an upper surface side of the arm 3. An accommodating space is defined in the central front of the arm 3 so as to accommodate a thread spool 10 when the cover 3*a* is in an open state. A needle thread drawn from the thread spool 10 is supplied through a thread supply passage including the needle thread take-up and the like to the needle 5.

On the front side of the arm 3 are mounted various switches including a start/stop switch 8*a* which is operable to start or stop a sewing work. A speed adjusting knob 8*b* is also mounted on the front side of the arm 3 to adjust a sewing speed or a rotational speed of the machine shaft. A large sized vertically long display 9 capable of full color display is provided on the front of the pillar 2. The display 9 includes a liquid crystal color display, for example. The display 9 is configured to display various sewing patterns such as ordinary patterns or embroidery patterns, names of functions to be executed in the sewing work, a setting screen for setting colors of an embroidery pattern as will be described later (see FIG. 5). Furthermore, the display 9 has a front to which is mounted a touch panel 9*a* (see FIG. 2) having a plurality of touch keys including transparent electrodes. When touch keys are depressed by user's finger or a touch pen (not shown), selection of a sewing pattern, instruction of various functions, setting of various parameters or the like are executable. The pillar 2 has a right side surface in which is formed a card slot 12 into which a memory card 11 (shown only in FIG. 2) storing embroidery data of various embroidery patterns and the like is insertable.

The bed 1 has an upper surface on which a needle plate (not shown) is mounted. The bed 1 houses a cloth feed mechanism which is located under the needle plate to move a feed dog vertically and horizontally, a horizontal rotating hook accommodating a bobbin and forming stitches in cooperation with the needle 5, and a thread cutting mechanism which cuts the needle and bobbin threads.

An embroidery frame transfer device 13 is detachably attached to a left part of the bed 1. The embroidery frame transfer device 13 includes a body 14 that is level with the upper surface of the bed 1 and a movable portion 15 which is mounted on an upper surface of the body 14 so as to be movable in the right-left direction. The movable portion 15 is provided with a carriage 17 which is movable in the front-back direction to detachably connect an embroidery frame 16 thereto. The embroidery frame 16 is configured to hold a workpiece cloth CL serving as an object to be sewn. The embroidery frame transfer device 13 includes an X-direction transfer mechanism (not shown) which moves the carriage 17 in the right-left direction together with the movable portion 15 and a Y-direction transfer mechanism (not shown) which moves the carriage 17 in the front-back direction. The embroidery frame 16 is moved in the right-left or X direction and in the front-back or Y direction by driving drive motors of the respective X-direction and Y-direction transfer mechanisms (an X-axis motor 18 and a Y-axis motor 19 as will be described later; and see FIG. 2) on the basis of the embroidery data of the embroidery pattern.

Figure 2:
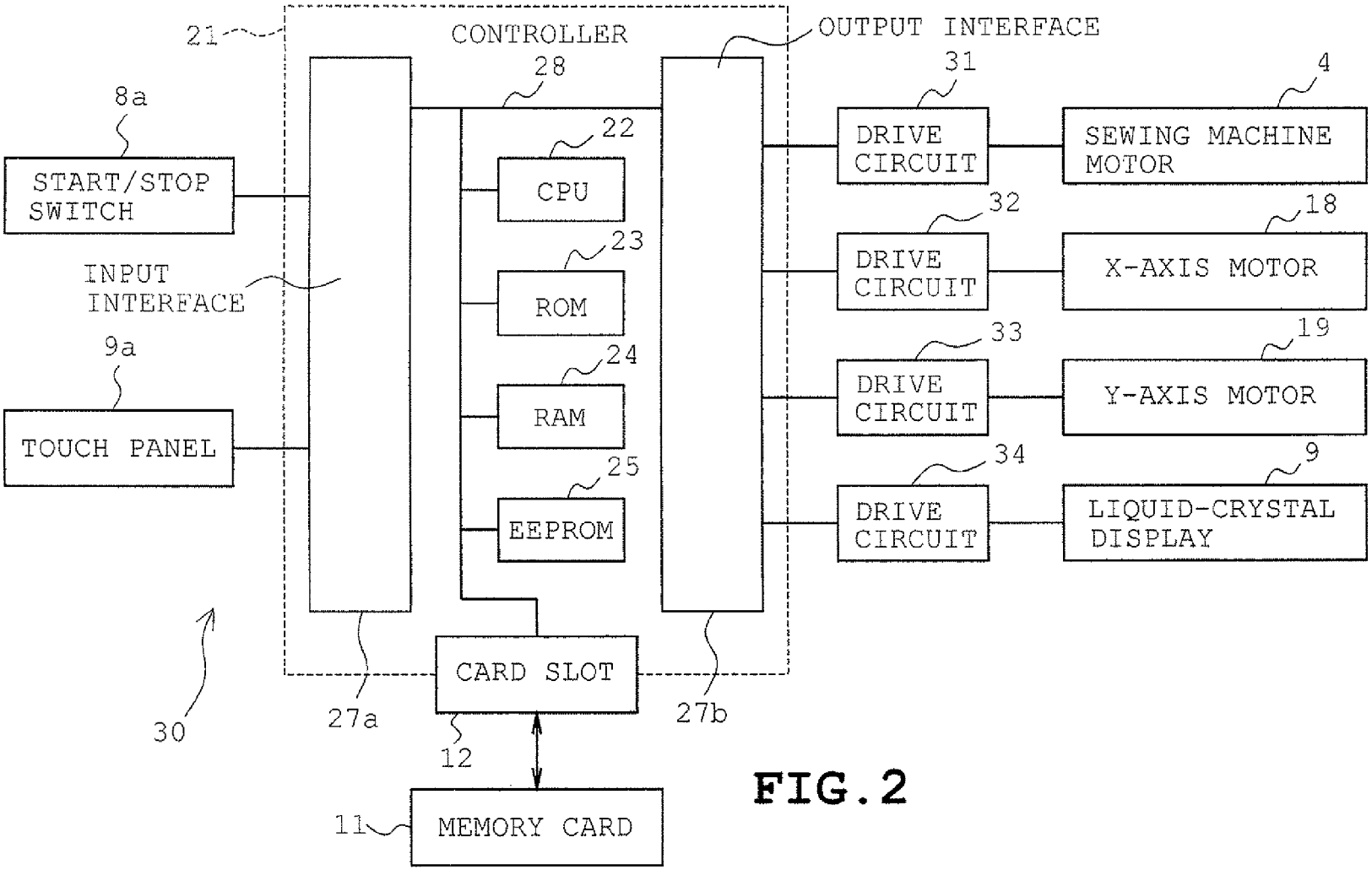
FIG. 2 is a block diagram showing an electrical arrangement of the machine.

The arrangement of the control system of the sewing machine M will now be described with reference to the block diagram of FIG. 2. A control device or processor 21 is configured mainly with a microcomputer and incorporates a CPU 22, a ROM 23, a RAM 24, an EEPROM 25, the card slot 12, input/output (I/O) interfaces 27*a* and 27*b* and a bus bar 28 connecting between the I/O interfaces 27*a* and 27*b*. The start/stop switch 8*a* and the touch panel 9*a* are connected to the input interface 27*a*. To the output interface 27*b* are connected drive circuits 31, 32, 33 and 34 driving the machine motor 4, the X-axis motor 18, the Y-axis motor 19 and the display 9 respectively. The control device 21, the display 9 and the drive circuit 34 serve as a display unit. An embroidery data generator 30 is constituted by the control device 21, the touch panel 9*a*, the display 9, the drive circuit 34 and the like.

The ROM 23 stores embroidery data, a sewing control program, a table of full thread information that relates to a plurality of types of threads used for embroidery sewing and includes thread color information, thread numbers and the like as will be described later. The ROM 23 also stores a display control program for controlling the liquid crystal display 9. The ROM 23 further stores an embroidery data processing program for causing the computer to function as various processing units for generation of embroidery data. These programs and data may be stored on an inner storage unit such as the EEPROM 25 or an external storage unit such as the memory card 11. For example, when the embroidery data processing program is stored on the external storage unit, the control device 21 reads the program onto the RAM 24 to execute the program.

Figure 3:
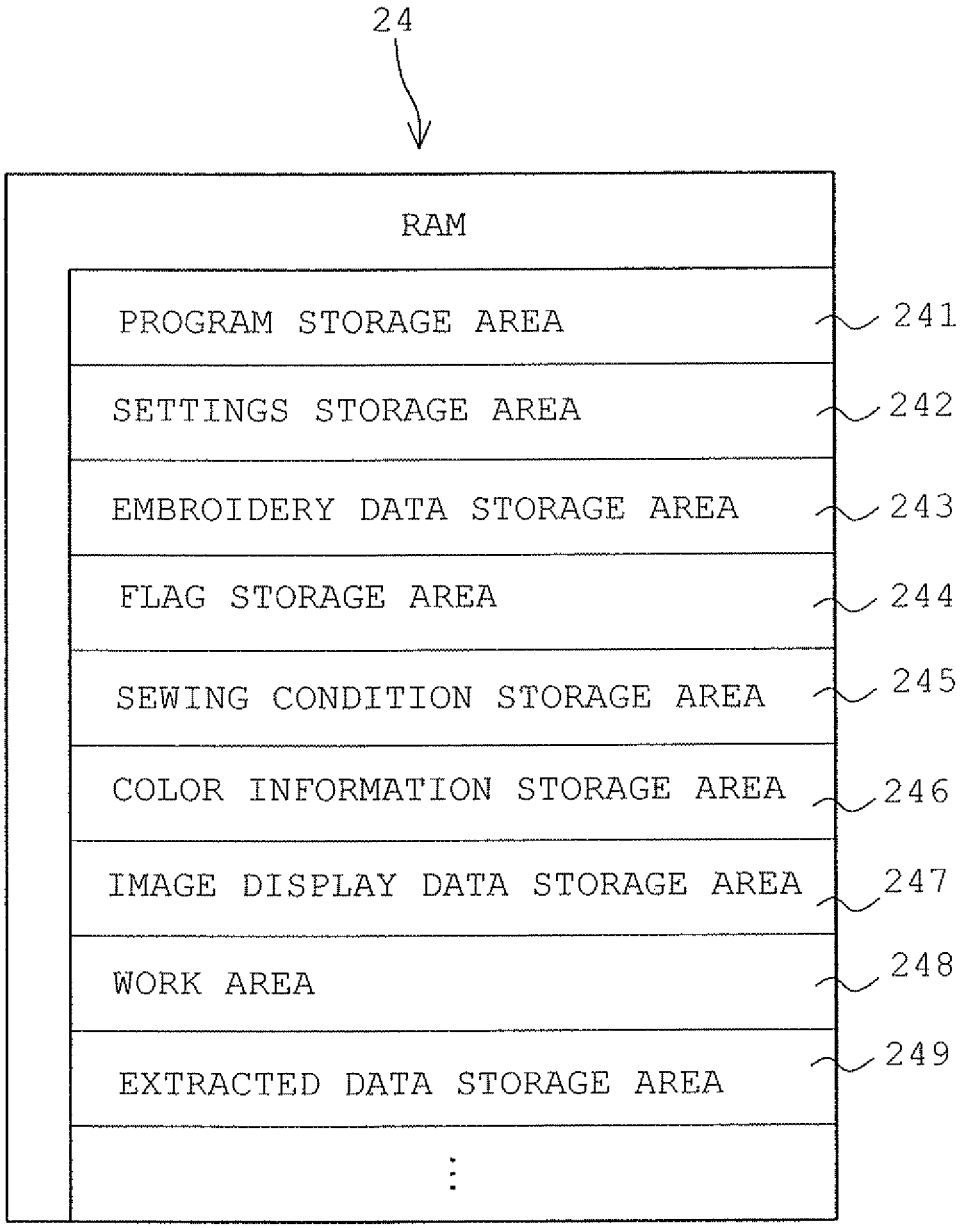
FIG. 3 schematically shows storage areas of a RAM of the machine.

The RAM 24 has a storage area for temporarily storing, as a storage unit, the aforementioned programs and data, various settings input by operation of the touch panel 9*a* or the like, results of an operation carried out by the control device 21, and the like. More specifically, as shown in FIG. 3, the RAM 24 is provided with a plurality of storage areas including a program storage area 241, a setting storage area 242, an embroidery data storage area 243, a flag storage area 244, a sewing condition storage area 245, a color information storage area 246, an image display data storage area 247, a work area 248, an extracted data storage area 249 and the like. The program storage area 241 stores various programs read from the ROM 23 or the like. The setting storage area 242 stores settings, tables and the like referred to during execution of a program. The embroidery data storage area 243 stores data serving as an original or a reference value in generation of embroidery data. The flag storage area 244 stores various flags used in execution of a program. The sewing condition storage area 245 stores various sewing conditions in the case of sewing an embroidery pattern.

The color information storage area 246 is provided with a buffer-by-contrasting-density which stores data used for coloration of an embroidery pattern. The buffer-by-contrasting-density is configured as a storage area storing the data divided into a plurality of groups having respective contrasting density levels as will be described in more detail later. Furthermore, the extracted data storage area 249 primarily stores data of a randomly extracted color. The image display data storage area 247 stores image data of screens to be displayed on the display 9 and display settings. The work area 248 preliminarily stores settings and the like during execution of various programs.

Figure 7:
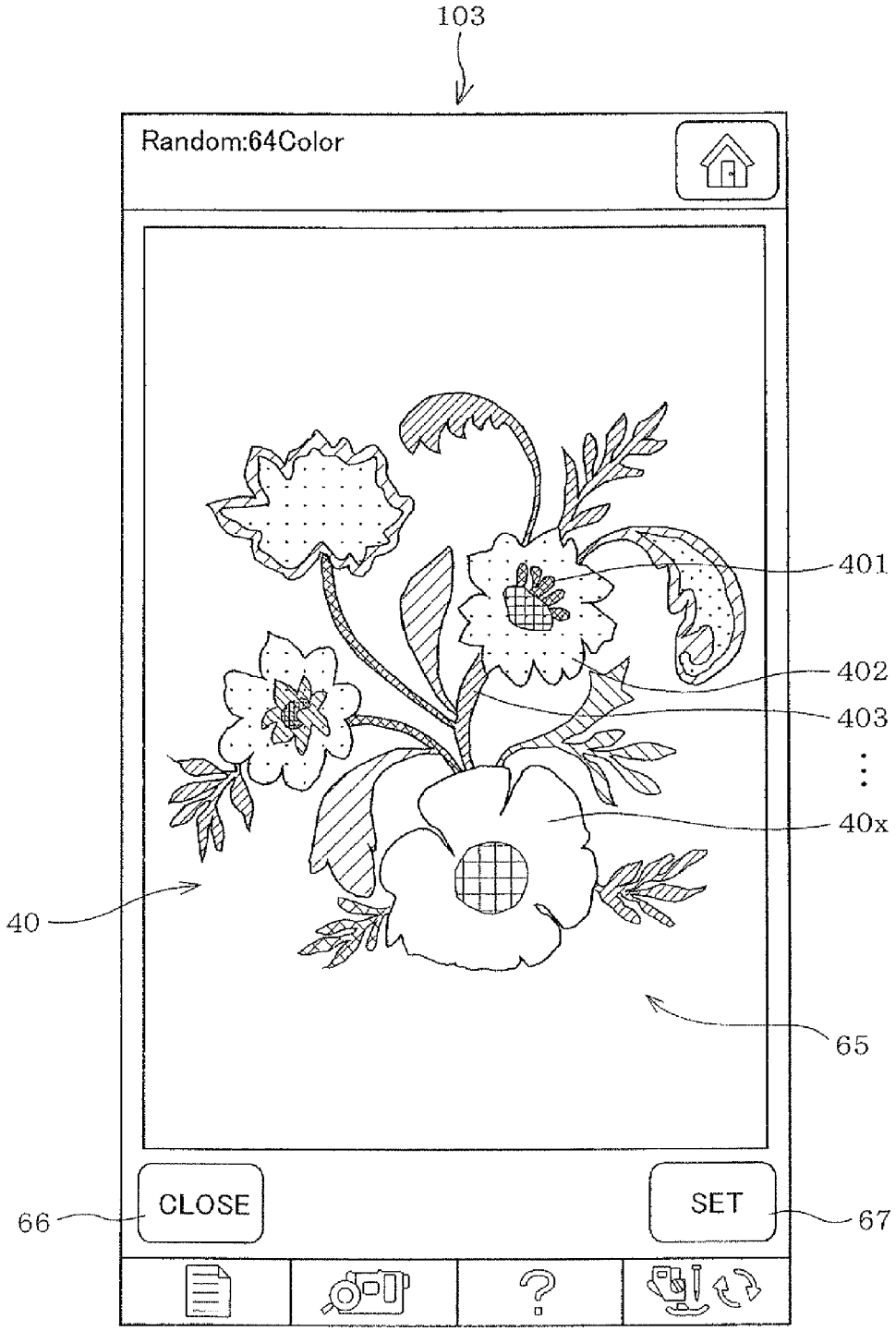
FIG. 7 is a view showing an example of an enlarged screen.

An embroidery pattern 40 of "flower" displayed on the screen 103 of the display 9 as shown in FIG. 7 will be described as an example of embroidery pattern. The embroidery pattern 40 includes first to x-th pattern parts 401 to 40*x* which are a plurality of (x number of) color-based pattern portions. More specifically, for example, a first pattern part 401 representing details of the flower is sewn by the use of a purple thread. A second pattern part 402 composing flower petals is sewn by the use of a rose-color thread. A third pattern part 403 composing a stalk is sewn by the use of a magenta thread. Thus, although the pattern parts 401 to 40*x* are the color-based pattern portions for which respective colors are set, the colors may not be different from one another.

Embroidery data is used for the sewing machine M to sew an embroidery pattern and includes data of a plurality of color-based pattern portions. For example, embroidery data of the embroidery pattern 40 includes data of a plurality of needle locations set for respective pattern parts 401 to 40*x*, sewing sequence data to specify a sewing sequence of the pattern parts 401 to 40*x* (patterns 1 to x) and thread color data. The thread color data is used to specify a color for every color-based pattern portion, and a color is assigned from color information to the thread color data by an assigning unit which will be described later.

An uppermost sewing sequence data "pattern 1" in FIG. 4 is to specify a sequence of pattern to be initially sewn. "Purple" corresponding to the sequence is actually thread color data indicated by RGB values, for example. Furthermore, needle location data "Xa0, Ya0" . . . "XaN, YaN" is position coordinates where a needle corresponding to a purple thread sequentially drops. In the same manner, each of second and subsequent embroidery data includes sewing sequence data "pattern 2" to "pattern x," thread color data "rose color" to "magenta" and needle location data "XbN, YbN" to "XxN, YxN." Furthermore, the embroidery data includes image data to be displayed on the display 9 (image data of bmp or the like, for example), and an image of embroidery pattern is displayed in colors assigned to respective thread color data on the display 9.

The EEPROM 25 stores information about a plurality of colors assigned as thread color data color information relates to thread colors of thread spools 10 which can be used with the sewing machine M and is defined as ROB values. More specifically, the EEPROM 25 stores a first pallet table (see a first color pallet 53 in FIG. 5) composed of RGB values of 64 colors and color-by-pallet numbers of 1 to 64 corresponding to the respective RGB values. The EEPROM 25 also stores a second pallet table (not shown) of a plurality of colors selected from the color information by the user in addition to the first pallet data. The second pallet table is a custom pallet table including RGB values of up to 300 colors and color-by-pallet numbers of 1 to 300 corresponding to the respective RGB values, both of which values are settable according to user's preference.

Furthermore, HSV values are also used in this example in addition to the RGB values. The HSV values are defined by hue, saturation and value in an HSV space, corresponding to the RGB values.

The HSV values are computed on the basis of RGB values by a known obtaining method by the control device 21 and represented by values of hue H, saturation S and value V. In this case, the hue represents a type of color such as red, purple, blue, etc. and has a value ranging from 0 to 360, for example. The saturation represents a color vividness and has a value ranging from 0.0 to 1.0 or from 0% to 100% (see FIG. 8), for example. The value represents color brightness and has a value ranging from 0.0 to 1.0.

Figure 5:
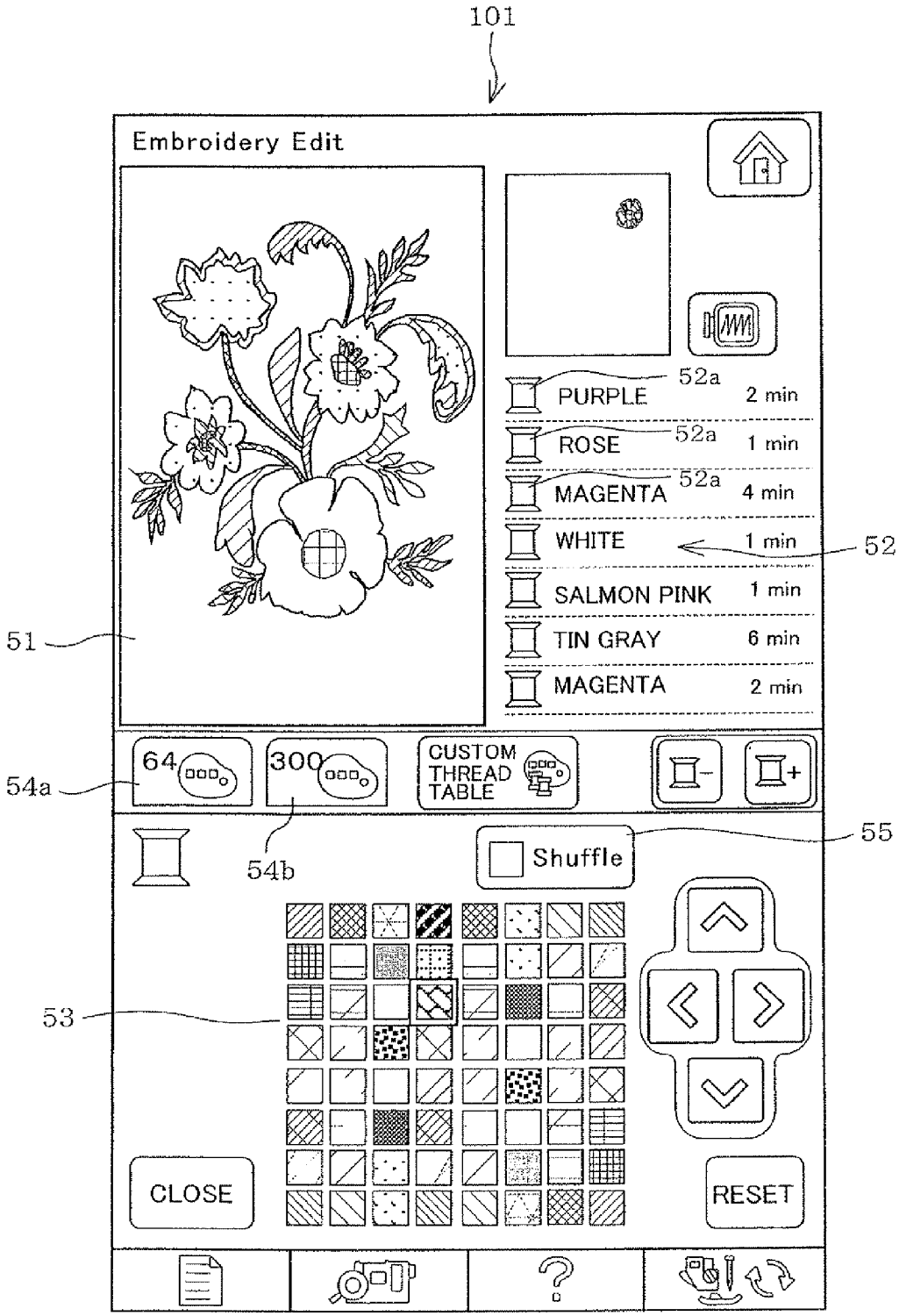
FIG. 5 is a view showing an example of a first color change screen when the embroidery data is generated.
Figure 6:
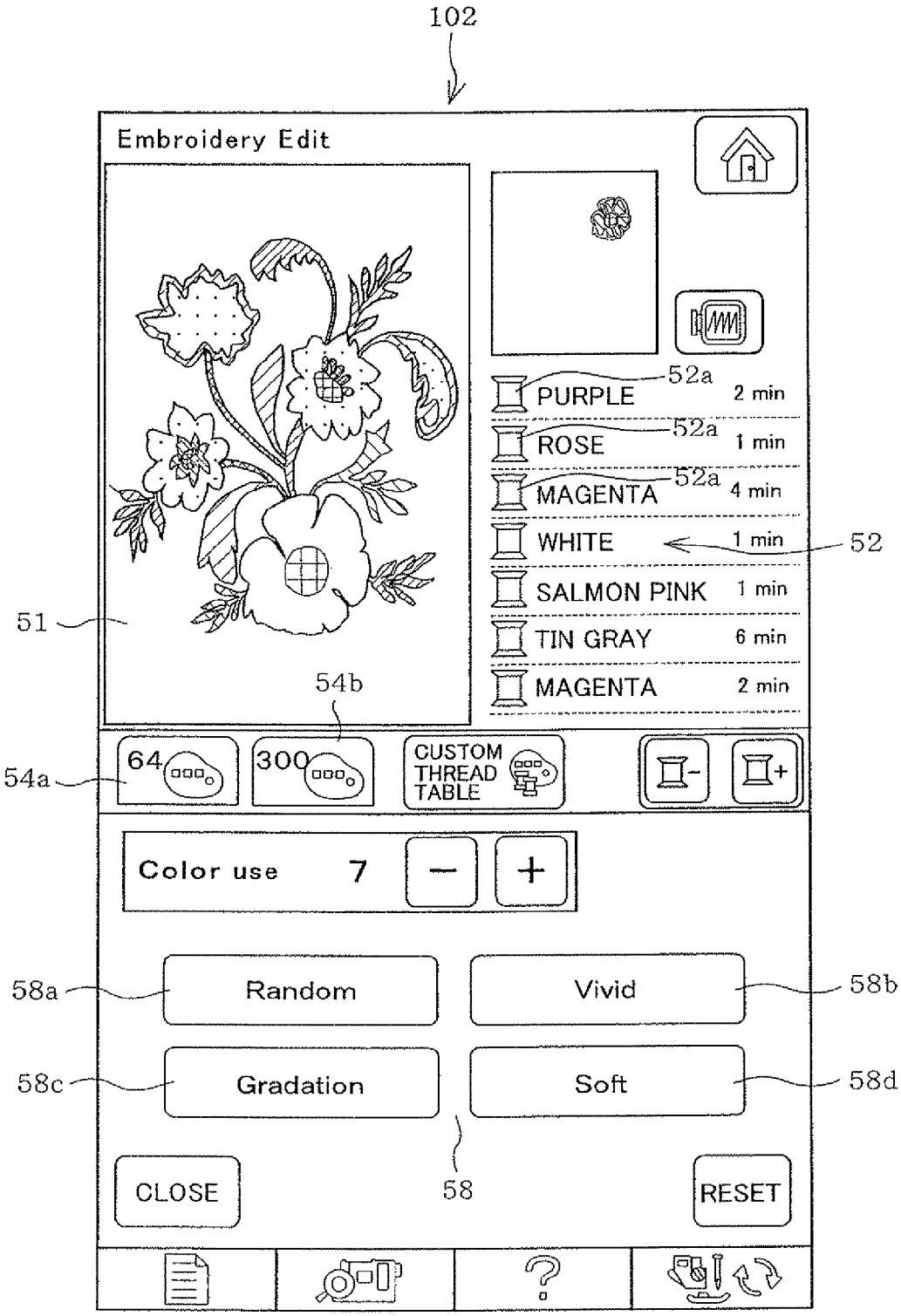
FIG. 6 is a view showing an example of a color setting screen.

Screens displayed on the display 9 in generating embroidery data or in particular, coloration of thread color data will be described with reference to FIGS. 5 to 7 in addition to FIGS. 1 to 4. FIGS. 5 to 7 explain display screens 101 to 103 of the display 9. Since the display 9 is a liquid crystal color display, images of embroidery patterns, the first color pallet 53, and the like on the screens 101 to 103 are displayable in multiple colors.

FIG. 5 exemplifies the first color change screen 101 displayed in the coloration of thread color data. The first color change screen 101 is provided with the first color pallet 53, a plurality of pallet selecting keys 54*a* and 54*b* and a shuffle key 55 in addition to a preview image area 51 and the thread color data designation area 52. A preview image displayed in the preview image area 51 shows a result of embroidering in the case where embroidering is executed on the embroidery data corresponding to an embroidery pattern selected by the user.

Various settings regarding a thread color are settable on the first color change screen 101. More specifically, the thread color data designation area 52 shows colors corresponding to color-based pattern portions of the embroidery pattern in the preview image area 51, together with an illustration of the thread spool 52*a*. When depressing the touch key corresponding to the thread spool 52*a* (hereinafter, referred to as "touch operation"), the user can designate a desirable color in the first color pallet 53 for every color-based pattern portion. For example, the first color pallet 53 has a top row to which RGB values of color-by-pallet numbers 1 to 8 of the first pallet table are assigned sequentially from the left one respectively, as shown in FIG. 5. Thus, the first color pallet 53 is a 64-color pallet in which eight pieces of color information are assigned to each of eight rows from the top row to the bottom row.

A second color change screen provided with a second color pallet is prepared separately from the first color change screen although not shown. The second color pallet of the second color change screen 2 has 300 squares capable of arranging up to 300 colors in 300 squares on the basis of the RGB values of the color information. The second color pallet corresponds to the second pallet table. When either one of a pair of pallet selecting keys 54*a* and 54*b* is touched, the display 9 is switched between the first color change screen 101 and the second color change screen. When the shuffle key 55 is touched, the display 9 is switched to a color setting screen 102 as shown in FIG. 6.

The color setting screen 102 is provided with a preview image area 51 and the like as the first color setting screen 101. The color setting screen 102 is also provided with a category setting part 58 and a random key 58*a*, instead of the first color pallet 53. The random key 58*a* is operated to extract a color at random for every thread color data from one of the pallet tables to thereby execute coloration. When the random key 58*a* is touched, an assigning process is executed in which a color to be used as thread color data is extracted at random to thereby be assigned to the pattern parts 401 to 40*x*. The category setting portion 58 is provided with keys 58*b*, 58*c* and 58*d* of "vivid," "soft" and "gradation" respectively. These "vivid," "soft" and "gradation" keys are provided for classifying color information by a plurality of categories. A plurality of colors belonging to the category of "vivid" has relatively higher saturation and is brilliant. A plurality of colors belonging to the category of "soft" is rarely different from the other categories in saturation and gives an impression of softness. A plurality of colors belonging to the category of "gradation" has respective hues within a predetermined range having a hue of a predetermined color as a center value.

After execution of the assigning process, the display 9 is switched to an enlarged screen 103 as shown in FIG. 5 when the random key 58*a* is touched. The enlarged screen 103 is provided with an enlarged image area 65, a close key 66, a set key 67 and the like. An embroidery pattern is displayed in an enlarged state in a color assigned by the assigning process. When the close key 66 is touched, the display 9 is returned to the color setting screen 102. When the set key 67 is touched, the embroidery data of the embroidery pattern is stored on the EEPROM 25 and the display 9 is returned to the first color change screen 101.

The control device 21 in the example is configured as a computation unit that computes a characteristic of each one of the first pattern part 401 to x-th pattern part 40*x*. The control device 21 executes an assigning process based on the obtained characteristic. This can realize a variety of coloration patterns according to the characteristic of the embroidery pattern while rendering color designation by the user unnecessary. More specifically, while referring to the needle location data of the embroidery data, the control device 21 obtains the number $n_1$ of stitches of the first pattern part 401, the number $n_2$ of stitches of the second pattern part 402, . . . the number $n_i$ of stitches of the i-th pattern part, the number $n_{(i+1)}$ of stitches of the (i+1)-th pattern part 40*x*, . . . and the number $n_x$ of stitches of the x-th pattern part 40*x*. All the stitch numbers n1, n2, . . . , $n_i$, $n_{(i+1)}$, . . . , $n_x$ are summed so that the total stitch number N of the embroidery pattern 40 is computed.

On the other hand, the EEPROM 25 stores a contrasting density table for determining a contrasting density level LV based on the saturation S, for example, as shown in FIG. 8. The saturation S is divided into a plurality of levels (levels LV1 to LV10, for example) in the contrasting density table. In this case, the contrasting density level LV1 is set so as to range above 0% and not more than 10%, and the contrasting density level LV10 is set so as to range above 90% and not more than 100%. Regarding an achromatic color with the saturation S of 0% (black or gray), a contrasting density level LV is determined based on a contrasting density value V. For example, "white" is classified into the contrasting density level LV1 and "black" is classified into the contrasting density level LV10. Furthermore, the contrasting density should not be limited to the classification on the basis of the contrasting density value V but may be set using RGB values.

The control device 21 obtains a unit stitch number $U_N$ by dividing the total stitch number N of the embroidery pattern 40 by the number of divisions (10, for example) of the contrasting density level LV ($U_N$=N/10). Each one of the pattern parts 401 to 40*x* is divided into ten levels for every unit stitch number based on the stitch number $n_1$ to $n_x$. The control device 21 assigns a color with a high contrasting density level LV to a pattern part having a relatively larger number of stitches and also assigns a color with a low contrasting density level LV to a pattern portion having a relatively smaller number of stitches, based on the corresponding division of stitch number and data of the buffer-by-contrasting-density (see steps A6 and so on of FIGS. 9A and 913). Thus, the information about stitch numbers $n_1$ to $n_x$ is understood as a characteristic indicative of the characteristic of each pattern part 401 to 40*x*.

Furthermore, the control device 21 controls the buffer-by-contrasting-density so that 64-color or 300-color RGB values corresponding to the first or second pallet table are stored on the buffer-by-contrasting-density (the color information storage area 246 of the RAM 24) in the form of divided groups LV1 to LV10 for every contrasting density. In this case, the buffer-by-contrasting-density stores not only RGB values of a plurality of colors belonging to each group but also color-by-contrasting-density numbers corresponding to the respective RGB values. Accordingly, the control device 21 is configured as a first allocation unit that allocates the colors of the first or second pallet table to a plurality of groups by contrasting density.

The control device 21 as a random number generation unit further generates a random number using a function with a maximum color-by-contrasting-density serving as a parameter. In the example, the control device 21 refers to the buffer-by-contrasting-density of the RAM 24 to generate a random number within a range of the number of colors belonging to the corresponding contrasting density level LV. The control device 21 extracts a color at random from the colors belonging to the corresponding contrasting density level, using the random numbers.

Figure 9A:
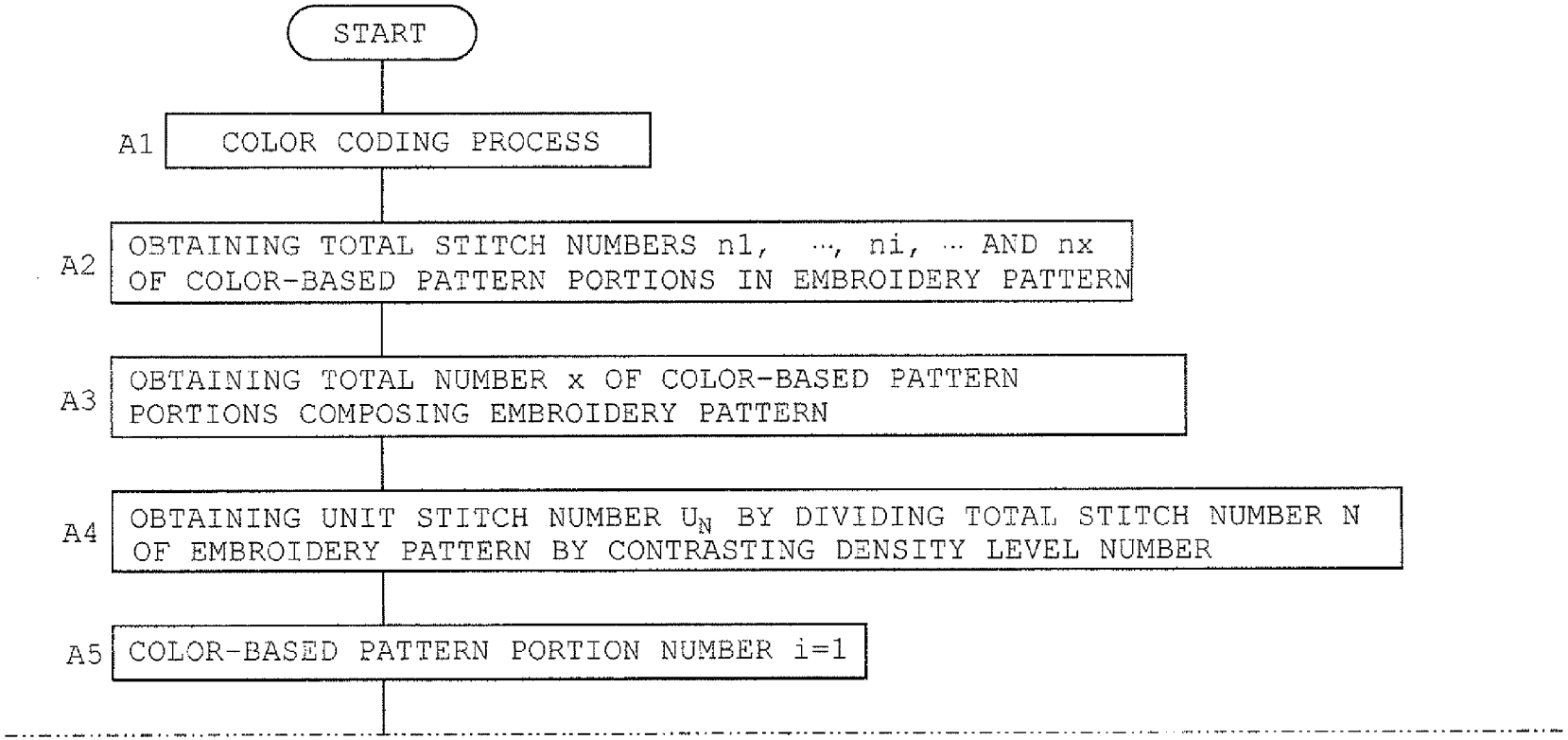
FIGS. 9A and 9B are flowcharts showing setting of thread color data in the embroidery data generation process.

The operation of the control device 21 on the embroidery data processing program will now be described with a focus on the coloration concerning the thread color data, with reference to FIGS. 9A and 9B. FIGS. 9A and 913 are flowcharts showing the processing procedure the control device 21 executes based on the embroidery data processing program. When the user touches the touch panel 9*a*, the control device 21 reads the embroidery data from the ROM 23 and displays a pattern selecting screen (not shown) on the display 9 according to the read embroidery data. The user touches a desired one of a plurality of embroidery patterns on the pattern selecting screen of the display 9 to thereby select a desired embroidery pattern. The display 9 is switched from the menu screen to generate embroidery data of the embroidery pattern to the first color change screen 101 in FIG. 5, so that a setting process is executed to carry out coloration of the embroidery pattern. When the pallet selecting key 54*b* is touched on the first color change screen 101, the display 9 is switched from the first color change screen 101 to the second color change screen. As a result, a pallet to be used for random coloration can be switched from the first color pallet 53 to the second color pallet. Furthermore, when the shuffle key 55 is touched, the display 9 is switched from the first color change screen 101 or the second color change screen to the color setting screen 102. When the random key 58*a* is touched on the color setting screen 102, a color coding process is started at step A1.

More specifically, when the display 9 has been changed from the first color change screen 101 to the color setting screen 102, the control device 21 determines that the first color pallet 53 has been selected, reading the RGB values corresponding to color-by-pallet number 1 of the first pallet table. Furthermore, the control device 21 computes an HSV value based on the read RGB values and checks the contrasting density table (see FIG. 8), whereby the color of color-by-pallet number 1 is stored as the color of new color-by-contrasting-density number 1 on the buffer-by-contrasting-density of the color information storage area 246. RGB values are also read regarding the colors of color-by-pallet number 2 and subsequent numbers, and new color-by-contrasting-density numbers are affixed to the corresponding intensities LV to be stored on the buffer-by-contrasting-density. Thus, the color-by-contrasting-density numbers are affixed to the 64 colors of the first color pallet 53 for every group of contrasting density levels LV1 to LV10 to be stored on the buffer-by-contrasting-density, whereupon the initial setting process at step A1 is completed.

When the second color pallet is set as the pallet used for coloration at step A1, the same processing as applied to the first color pallet 53 is carried out for the second color pallet. More specifically, when the display 9 is switched from the second color change screen to the color setting screen 102, the buffer-by-contrasting-density stores RGB values allocated by contrasting density levels LV1 to LV10 and color-by-contrasting-density numbers associated with the respective RGB values, with respect to the 300 colors of the second color pallet.

At step A2, the control device 21 obtains stitch numbers $n_1$, . . . , $n_i$, . . . and $n_x$ of each color-based pattern portion as the characteristic while referring to the needle location data concerning the selected embroidery pattern. The control circuit 21 then obtains a total number x of color-based pattern portions composing the embroidery pattern while referring to the embroidery data (step A3). At step A4, the control device 21 further divides, by 10 as the number of divisions of the contrasting density, the total stitch number N of the embroidery pattern that is a sum of the stitch numbers $n_1$ to $n_x$, thereby obtaining a unit stitch number $U_N$(=N/10). The control device 21 further sets to 1 a counter i corresponding to the sewing sequence of the color-based pattern portion (step A5) and executes an allocating routine of random coloration based on the aforementioned characteristic and buffer-by-contrasting-density data, for every color-based pattern portion (steps A6 to A29).

The processing after step A6 will now be described in detail with a concrete example. For example, assume that the total number N of stitches of an embroidery pattern 40 is 1,000 and the unit number $U_N$ of stitches is accordingly 100. In this case, the control device 21 determines at step A6 whether or not the number $n_1$ of stitches of a first pattern portion 401 is not more than 100 ($U_N$). When the stitch number $n_1$ is not more than 100 (YES at step A6), the control device 21 refers to the buffer-by-contrasting-density of the RAM 24 to generate a random number within a range of the total number of colors belonging to the contrasting density level LV10 (step A16). When the total number of colors or a maximum of the color-by-contrasting-density number is 7, for example, the control device 21 generates random numbers of 1 to 7. The control device 21 then checks the color-by-contrasting-density number corresponding with the random number to thereby extract a color (RGB values) corresponding to the color-by-contrasting-density number.

As a result, the color to be used as thread color data is extracted at random from the colors belonging to the contrasting density level LV10 that has the lowest contrasting density, with respect to the first pattern portion 401 with the smallest number $n_1$ of stitches (see FIG. 7). The color thus initially extracted is stored in the extracted data storage area 249 of the RAM 24 without any change (YES at step A26) as a color to be assigned to the first pattern portion 401 (step S27).

The counter i is updated to i=i+1 every time an extracted color is stored in the extracted data storage area 249 of the RAM 24 (step A28). The processing at step A6 and subsequent steps are also executed concerning the extraction of second and subsequent colors (YES at step A29). More specifically, the control device 21 determines whether or not the number $n_2$ of stitches of a second pattern part 402 is not more than 100 ($U_N$). When the number $n_2$ of stitches exceeds 100 (NO at step A6), the control device 21 determines at step A7 whether or not the number $n_2$ of stitches of a second pattern portion 402 is not more than 200 ($2U_N$). Thus, a plurality of ranges are set to be increased for every 100 stitches (unit stitch number $U_N$), and the control device 21 determines which one of the ranges the number $n_2$ of the second pattern portion 402 belongs to. When determining that the number of stitches belongs to any one of the ranges at any one of steps A6 to A15 (YES), the control device 21 extracts at random one of the colors with the contrasting density level LV corresponding to the determined number n of stitches. In the example, as shown at steps A15 and A25, a color is extracted from a group (LV1, for example) with a lower contrasting density level as the color-based pattern portion has a large number n of stitches. Furthermore, a color is extracted from a group (LV10, for example) with a higher contrasting density level as the color-based pattern portion has a small number of stitches, as in the case of the above-described first pattern part 401.

A color is re-extracted when any one pair of the steps A6 and A16, steps A7 and A17, . . . and steps A15 and A25 is executed and an extracted color overlaps the already extracted one (NO at step A26 and YES at step A29). When the extracted color does not overlap any one of the previously extracted colors, data of the extracted color is stored and the counter i is incremented (steps A27 and A28). The control device 21 executes the assigning process at steps A6 to A29 until determining that the added number i of the color-based pattern portions has exceeded the total number x (NO at step A29). Consequently, the colors assigned by the assigning process are stored in the extracted data storage area 249 without overlap so as to correspond to the respective pattern parts 401 to 40*x*, and the assigning process is completed.

Subsequently, the embroidery pattern 40 is displayed in colors assigned to the respective color-based pattern portions on the enlarged screen 103 as shown in FIG. 7. A color with a lower contrasting density is assigned to the color-based pattern portion having a larger number n of stitches (see reference symbol 40*x* in FIG. 7), and a color with a higher contrasting density is assigned to the color-based pattern portion having a smaller number n of stitches (see reference symbol 401 in FIG. 7). The number n of stitches becomes larger as areas of the color-based pattern portions are generally large, and the number n of stitches generally becomes smaller as areas of the color-based pattern portions are small, as will be described later.

When the set key 67 is touched on the enlarged screen 103, embroidery data of the embroidery pattern is stored on the EEPROM 25, and the control sequence returns to the first color-change screen 101. On the other hand, when the close key 66 is touched, the control sequence returns to the color setting screen 102, whereupon the random coloration process can be re-executed.

The control device 21 executes, as an assigning unit, an assigning routine in which the colors used as thread color data are extracted at random and assigned at steps A6 to A29, as described above. The control device 21 also executes, as the first computation unit, the first computation routine of computing the characteristic concerning the number n of stitches at step A2 and further executes, as the second computation unit, the second computation routine of computing the total number x of color-based pattern portions at step A3.

The control device 21 of the embroidery data generator 30 serves as the assigning unit and a computation unit and executes the assigning process in the assigning routine based on the characteristic of the color-based pattern portion computed in the first computation routine. Furthermore, a random coloration can be carried out when the colors extracted by the assigning process are assigned to the thread color data of the color-based pattern portions of the embroidery pattern. Accordingly, a troublesome work such as confirmation and designation of thread color data can be eliminated, whereby the coloration of the embroidery pattern can easily be carried out. Since a color is assigned based on the characteristic of each color-based pattern portion particularly in the assigning process, a variety of coloration patterns according to the respective characteristics can efficiently be obtained as a whole embroidery pattern.

The control device 21 executes the assigning process in the assigning routine based on the numbers n of stitches obtained for every color-based pattern portion in the first computation routine. This can efficiently obtain an appropriate coloration pattern according to the number n of stitches for every color-based pattern portion.

The control device 21 executes, as a first allocation unit, a first allocation routine of allocating a plurality of colors to a plurality of groups (levels LV1 to LV10, for example) stored on the buffer-by-contrasting-density, thereby extracting colors at random from the respective groups. Thus, a desired coloration can easily be achieved in the allocation process by allocating a plurality of colors to a plurality of groups respectively.

The control device 21 allocates the colors to the respective groups based on the saturation of the colors to thereby extract the colors at random from the color group with the lower contrasting density as the number n of stitches becomes large and the colors at random from the color group with the higher contrasting density as the number n of stitches small. Accordingly, a color with the higher contrasting density and high visibility can be assigned to the color-based pattern portion having small number n of stitches while the embroidery pattern has a random coloration. Thus, a highly attractive coloration can be obtained as a whole.

Furthermore, since the plurality of groups are classified into levels LV1 to LV10 in which the intensities of the colors are gradually increased, a color can be obtained which is indicative of the gradation according to the number of groups between the color-based pattern portions regarding the coloration of the embroidery pattern.

The control device 21 computes the total number x of the color-based pattern portions in the second computation routine and carries out the assigning process based on the obtained total number x. Accordingly, the coloration of the embroidery pattern can easily be carried out according to the total number x of the color-based pattern portions.

The embroidery pattern is displayed on the display 9 serving as the display unit in the color assigned to the thread color data of each color-based pattern portion. Accordingly, the colors of the respective color-based pattern portions can easily be understood visually in the generated embroidery data.

Second Example

FIGS. 10 and 11 illustrate a second example and only the differences between the first and second examples will be described. The contrasting density table in the second example is set so that the number of divisions of the contrasting density level LV corresponds to the total number x of the color-based pattern portions, as shown in FIG. 10. Accordingly, the saturation S of the contrasting density table is represented by the unit saturation $U_S$ obtained by dividing the saturation S by the total number x of the color-based pattern portion. As a result, the saturation S is divided into ranges from unit saturation 0 to $U_S$, from $U_S$ to $2U_S$, from $(i-1)\ U_S$ to $iU_S$, . . . and from $(x-1)\ U_S$ to 100% corresponding to color intensities LV1, LV2, . . . and x respectively in FIG. 10.

Figure 9B:
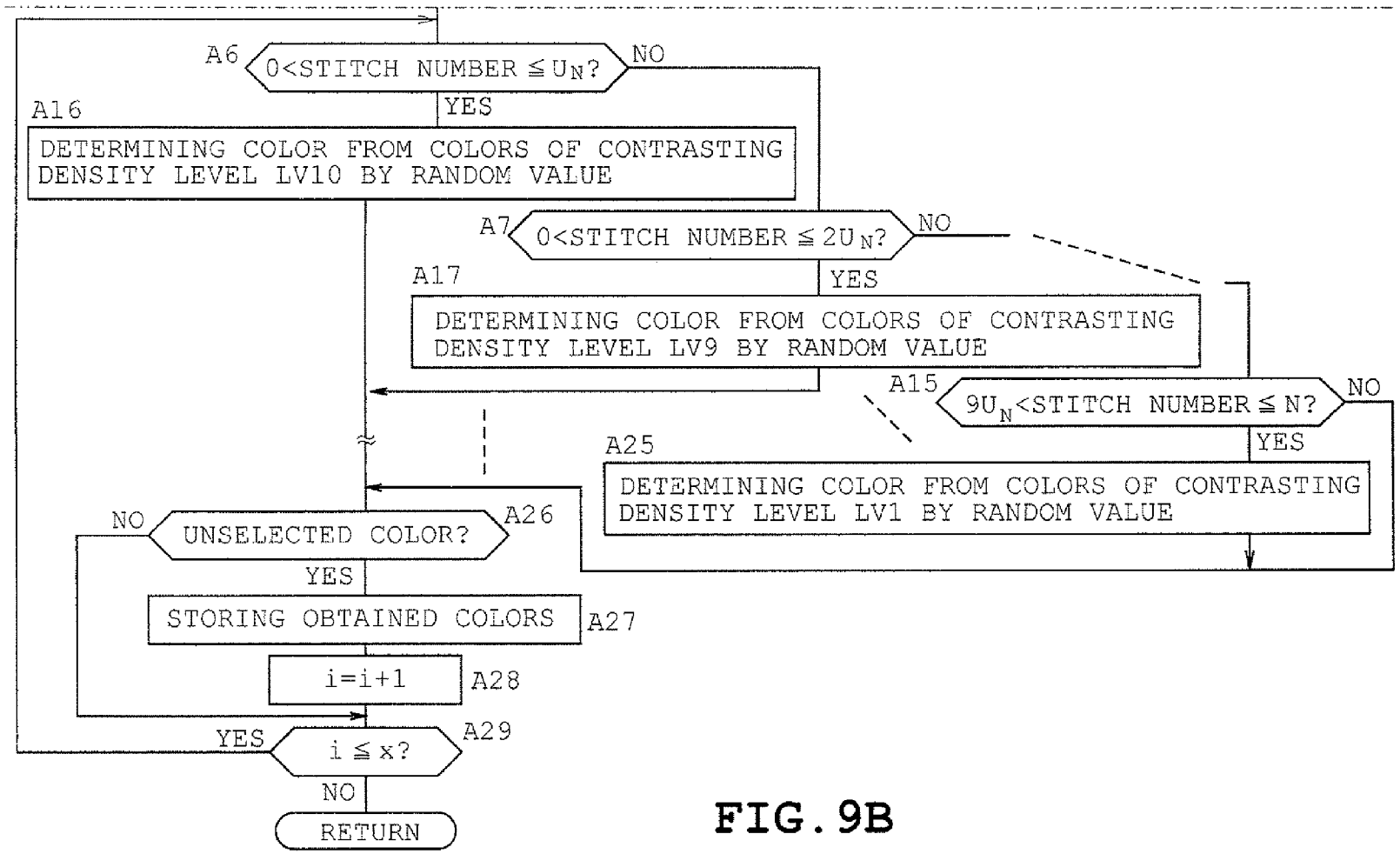
Figure 11A:
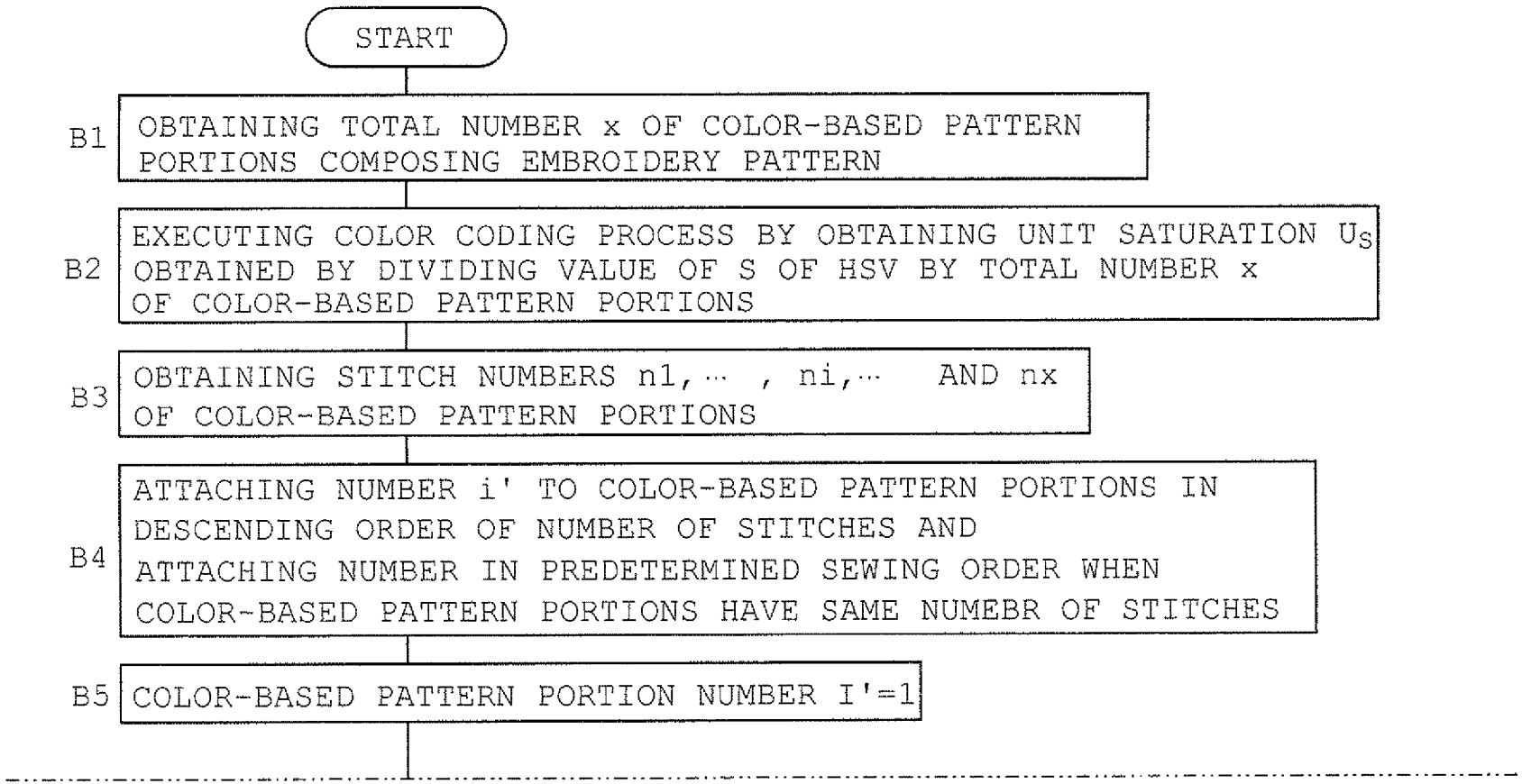
FIGS. 11A and 11B are views similar to FIGS. 9A and 913.
Figure 11B:
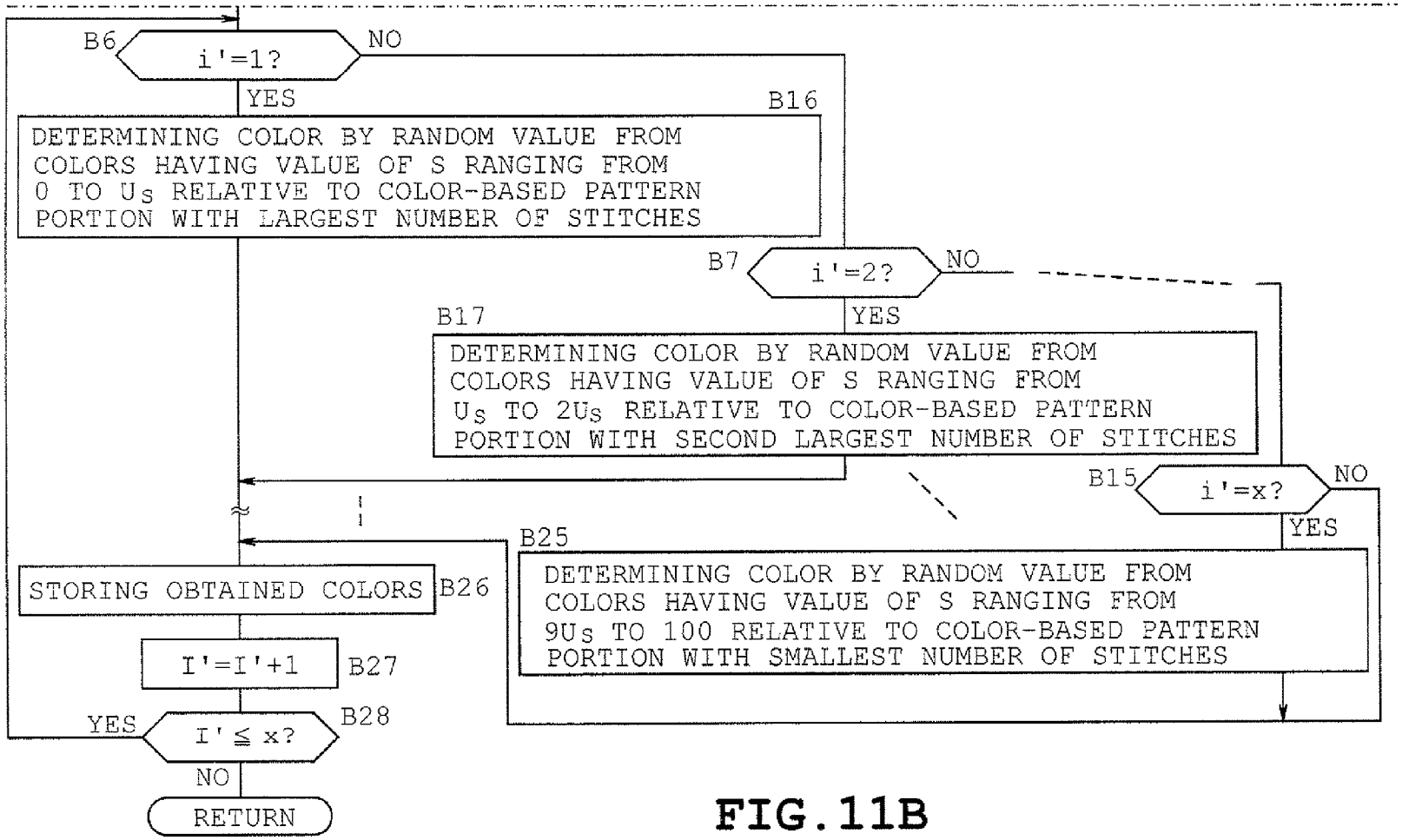

The following describes a process of generating the contrasting density table and the assigning process on the basis of the generated contrasting density table with reference to a flowchart of FIGS. 11A and 11B showing the processing procedure corresponding to FIGS. 9A and 9B of the first example. When the random key 58*a* is touched on the color setting screen 102, the control device 21 refers to the selected embroidery data to obtain a total number x of the color-based pattern portions (step B1). The control device 21 then divides the saturation S by the total number x of color-based pattern portions to thereby obtain a unit saturation $U_S$, thereby generating a contrasting density table in which the contrasting density is divided by the unit saturation $U_S$ into divisions the number of which corresponds with the total number x of color-based pattern portions. The control device 21 also executes a color coding process (see step B2 in FIGS. 11A and 11B and FIG. 10).

In the color coding process, the control device 21 allocates 64 colors of the first color pallet 53 or 300 colors of the second color pallet to the contrasting density levels LV1 to LVx. In this case, the control device 21 stores, on the buffer-by-contrasting-density, RGB values obtained by allocating a plurality of colors in the first or second color pallet to x number of contrasting density levels LV according to the total number x of color-based pattern portions. The control device 21 also stores data of color-by-contrasting-density numbers associated with the RGB values for every contrasting density level LV on the buffer-by-contrasting-density.

At step B3, the control device 21 refers to the needle location data of the selected embroidery pattern to obtain numbers $n_1$ to $n_x$ of stitches of respective color-based pattern portions as the characteristic. The control device 21 further changes the sewing sequence data based on the numbers $n_1$ to $n_x$ of stitches regarding the selected embroidery pattern, that is, the embroidery data read into the RAM 24 (step B4). More specifically, for example, pattern portions 1 to x indicative of the sewing sequence is updated to a sewing sequence i' in which the pattern portions 1 to x are rearranged in descending order of number n of stitches in FIG. 4. When one or more values are equal to another value between numbers $n_1$ to $n_x$ of stitches, the control device 21 determines the sequence of number n of stitches according to the original sewing sequence.

The control device 21 then sets to 1 a counter i' concerning the sequence of number n of stitches between color-based pattern portions (step B5). The control device 21 then executes a process of allocating colors at random to the respective color-based pattern portions based on the sewing sequence i' in descending order of number n of stitches and data of the buffer-by-contrasting-density (step B6 and subsequent steps).

More specifically, for example, assume now that the embroidery pattern 40 is composed of five pattern portions 401 to 40*x* (total number x=5). Since the saturation S is divided into five divisions the number of which corresponds with the total number x in this case, the unit saturation $U_S$ is set to 20%. The control device 21 determines whether or not the counter i' is set to 1, that is, whether or not the color-based pattern portion has a largest number n of stitches (step B6). In the case of the fifth color-based pattern portion 40*x* having the largest number n of stitches (YES), the control device 21 refers to the buffer-by-contrasting-density of the RAM 24 to generate a random number within a range of the total number of colors belonging to the contrasting density level LV1 (step B16). The control device 21 further refers to a color-by-contrasting-density number corresponding to the random number generated at contrasting density level LV1 to extract a color of the corresponding color-by-contrasting-density number. Consequently, the control device 21 extracts at random a color belonging to the contrasting density level LV1 with a lowest contrasting density or a color to be assigned to the fifth pattern portion 40*x* with the color saturation S ranging from 0% to 20%. As a result, the color to be assigned to the fifth pattern portion 40*x* with the largest number $n_x$ of stitches is initially extracted to be stored in the extracted data storage area 249 of the RAM 24 without any change (step B26).

The counter i' is updated to i'=i'+1 every time data of an extracted color is stored in the extracted data storage area 249 of the RAM 24 (step B27). Furthermore, the processing at step B6 and subsequent steps is also executed concerning the color-based pattern portion with a second largest number n of stitches (YES at step B28). More specifically, in the case of the color-based pattern portion with the second largest number n of stitches (NO at step B6; and YES at step B7), the control device 21 extracts a color at random from the colors belonging to a group of a contrasting density level LV2 with a second lower contrasting density (step B17). The extracted color is associated with the color-based pattern portion to be stored in the extracted data storage area 249. Furthermore, the counter i is incremented (steps B26 and B27).

Thus, in the example, steps B6 and B16, steps B7 and B17, . . . are sequentially executed and steps B15 and B25 are finally executed. At steps B15 and B25, the control device 21 extracts a color at random from the colors belonging to the contrasting density level LV5 with a highest contrasting density, concerning the first pattern portion 401. As a result, the colors assigned by the assigning process are stored in the extracted data storage area 249 so as to correspond to the respective pattern portions 401 to 40*x* without any overlap, and the assigning process is completed or the control device 21 returns.

The control device 21 in the second example executes, as a second allocation unit, a second allocation routine of allocating the plural colors to the plural groups (LV1 to LVx) according to the total number x of color-based pattern portions (step B2). Furthermore, in the assigning process, the colors are extracted at random from the groups allocated in the second allocation routine for every color-based pattern portion to thereby be assigned. Accordingly, the assigning process can be executed with the groups having different colors so that the colors can be prevented from overlapping between color-based pattern portions. This can achieve a predetermined coloration according to the number of color-based pattern portions while a random coloration is employed for the embroidery pattern.

In the second allocation routine, the control device 21 allocates the plural colors to a plurality of groups according to the total number x of the color-based pattern portions on the basis of contrasting density. Furthermore, in the assigning process, the control device 21 extracts a color at random from a group (LV1) with the lower contrasting density out of the groups (LV1 to LVx) as the color-based pattern portion has a large number n of stitches and from a group (LVx) with the higher contrasting density out of the groups as the color-based pattern portion has a small number n of stitches. Consequently, a color can easily be obtained which is indicative of the gradation according to the number of groups between the color-based pattern portions regarding the coloration of the embroidery pattern, while a random coloration is employed for the embroidery pattern (see FIG. 7).

In the example, the total number x of color-based pattern portions is equal to the number of groups (LV1 to LVx) to be assigned and a color is extracted from a group differing for every color-based pattern portion. Accordingly, the color belonging to each group can evenly be assigned, and a suitable assigning process utilizing all the color groups can be carried out.

Third Example

Figure 12A:
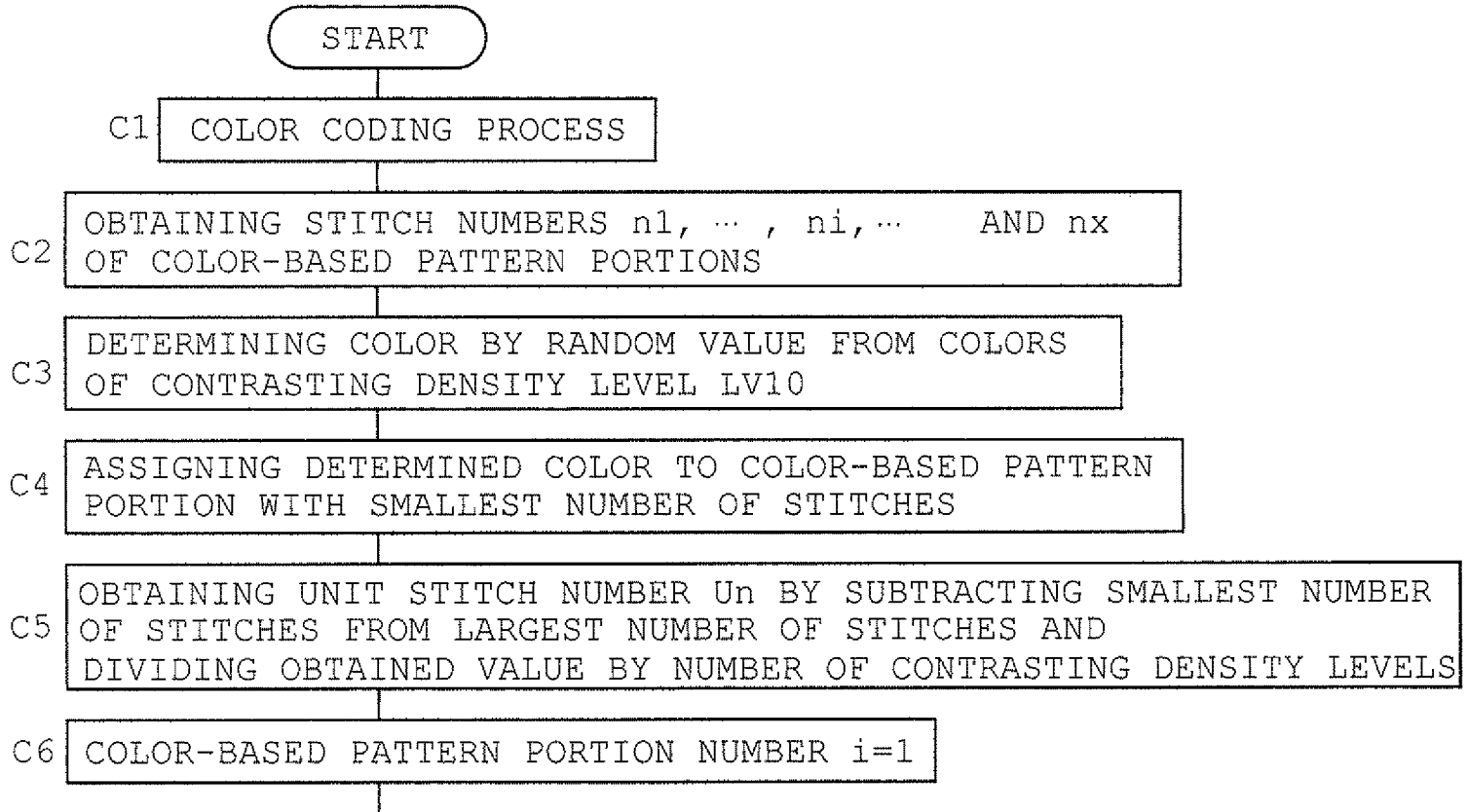
FIGS. 12A, 12B and 12C are views similar to FIGS. 9A and 9B, showing a third example.
Figure 12B:
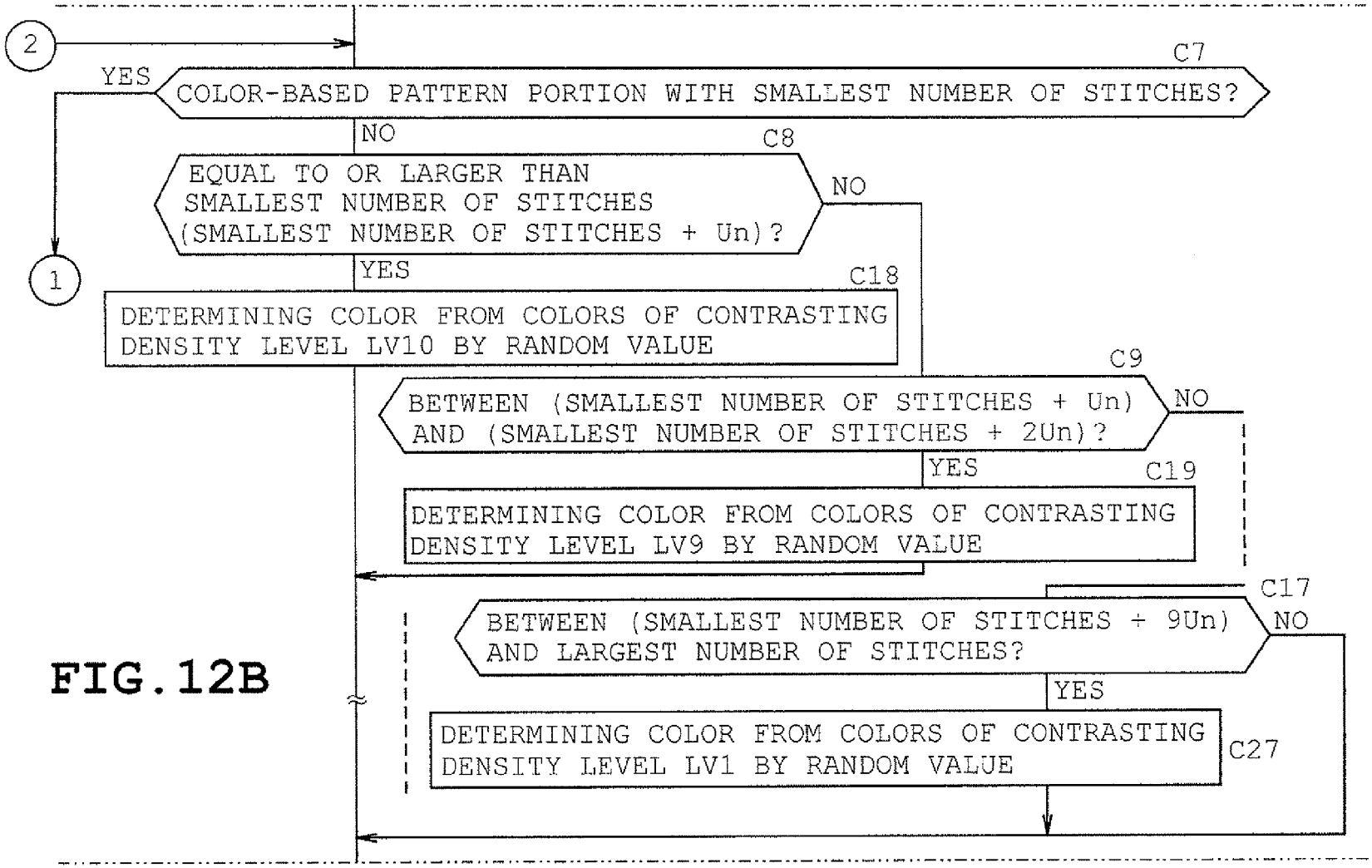
Figure 12C:
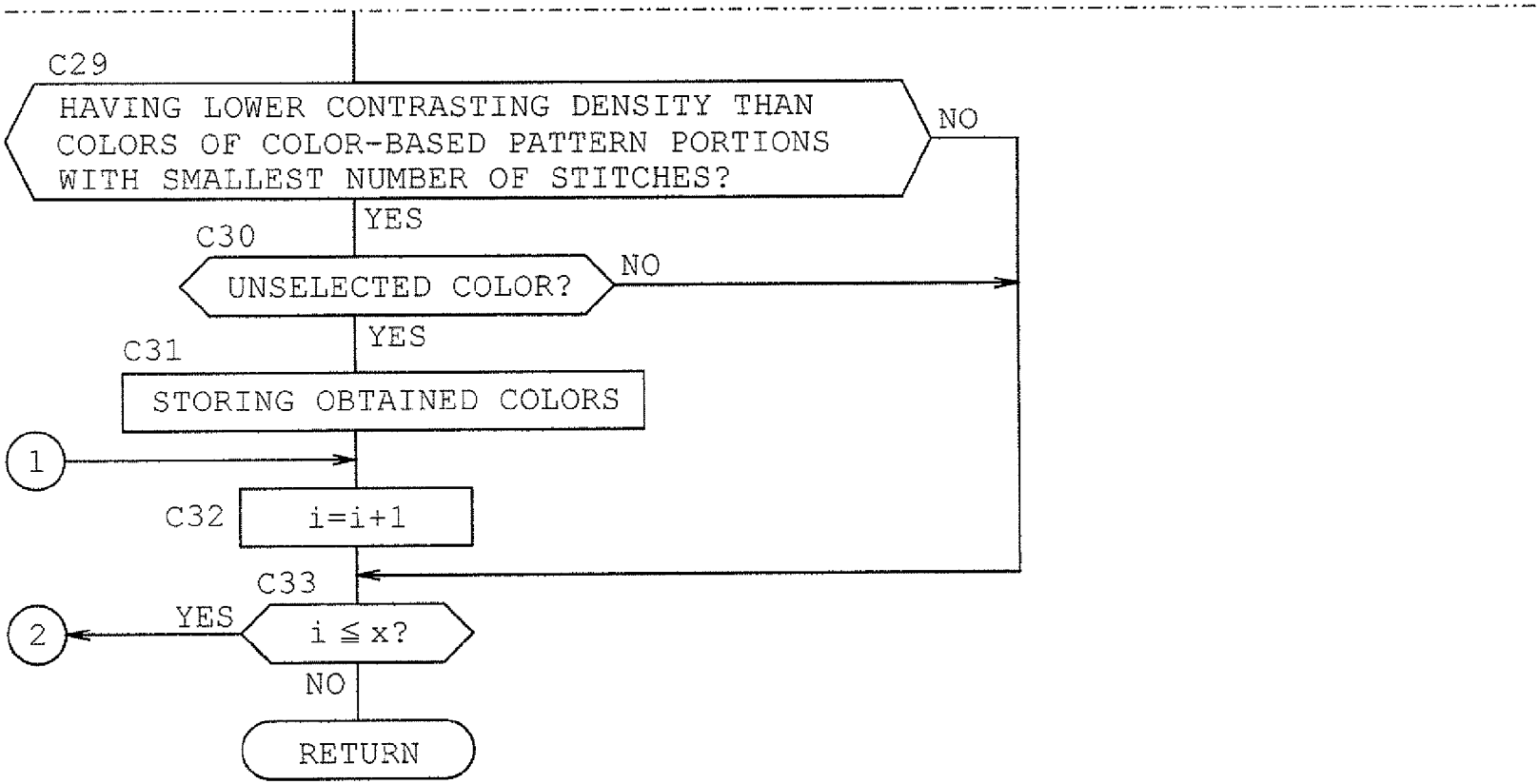

FIGS. 12A, 12B and 12C illustrate a third example, and the difference between the first and third examples will be described. FIGS. 12A-12C are flowcharts showing the processing procedure corresponding to FIGS. 9A and 9B of the first example.

The color coding process is started (step C1) when the touch panel 9*a* is touched for selection of a desired embroidery pattern and the random key 58*a* is touched. In the color coding process, RGB values assigned by contrasting density levels LV1 to LV10 and color-by-contrasting-density numbers corresponding to the respective contrasting density levels are stored on the buffer-by-contrasting-density concerning 64 colors of the first color pallet 53 or 300 colors of the second color pallet as in the foregoing step A1.

At step C2, the control device 21 refers to the needle location data concerning the selected embroidery pattern to obtain numbers $n_1$ to $n_x$ of stitches of color-based pattern portions as characteristics. The control device 21 then refers to the buffer-by-contrasting-density assigned at step C1 to generate a random number within a range of the total number of colors belonging to the contrasting density level LV10 (step C3). The control device 21 then checks the color-by-contrasting-density number corresponding with the random number generated at the contrasting density level LV10, extracting the color corresponding to the color-by-contrasting-density number.

The color extracted at step C3 is assigned to the color-based pattern portion with the smallest number n of stitches (step C4). Thus, a color extracted at random from the group (LV10) to which the colors with the highest contrasting density belong is associated with the color-based pattern portion having the smallest number n of stitches and stored in the extracted data storage area 249 of the RAM 24.

Assume now that the first color-based pattern portion 401 has a smallest number $n_1$ of stitches in a plurality of color-based pattern portions and the x-th color-based pattern portion 40*x* has a largest number $n_x$ of stitches, for example. The smallest number $n_1$ is subtracted from the largest number $n_x$, and the obtained value is divided by the number of contrasting density levels (10, for example), whereby a unit number $U_n$ ($=(n_x-n_1)/10$) of stitches is obtained (step C5). The control device 21 then sets to 1 the counter i corresponding to the sewing sequence of the color-based pattern portion (step C6) and executes the assigning process of assigning a color to each color-based pattern portion based on the unit number $U_n$ of stitches, the buffer-by-contrasting density and the like at random (step C7 and subsequent steps).

More specifically, firstly, the color has already been assigned to the first color-based pattern portion 401 as the color-based pattern portion with the smallest number n of stitches at steps C3 and C4 (YES at step C7). Accordingly, the control device 21 updates the counter i to i=i+1 (step C32) and then executes the assigning process concerning the second color-based pattern portion 402 (YES at step C33 and NO at step C7). At step C8, the control device 21 determines whether or not the number $n_2$ of stitches of the second color-based pattern portion 402 ranges from the smallest number $n_1$ of stitches to the number ($n_1+U_n$) of stitches obtained by adding the unit number $U_n$ of stitches to the smallest number $n_1$ of stitches. When the number $n_2$ of stitches exceeds $n_1$ and is not more than ($n_1+U_n$) (YES at step C8), the control device 21 refers to the buffer-by-contrasting-density to generate a random number within a range of the total number of colors belonging to the contrasting density level LV10 (step C18). The control device 21 further checks the color-by-contrasting-density number corresponding to the random number generated at contrasting density level LV10, extracting the color of the color-by-contrasting-density number.

At step C29, the control device 21 determines whether or not the color extracted at step C18 is lighter than the color assigned to the first color-based pattern portion 401 of the smallest number $n_1$, by comparing the respective saturation values S. When the extracted color has a higher contrasting density (NO at step C29), the control device 21 executes steps C7, C8, C18, C29 and C33 repeatedly until extracting a color with a lower contrasting density at step C18. When determining that the extracted color has a higher contrasting density (YES at step C29), the control device 21 associates the extracted color with the second color-based pattern portion 402 on the condition that the extracted color does not overlap the previously extracted colors (YES at step C30), storing data of the extracted color in the extracted data storage area 249 of the RAM 24 (step C31).

In the above-described example, the assigning process is carried out firstly so that a color is assigned to the first color-based pattern portion 401 having the smallest number n of stitches and secondly so that colors lighter than the assigned color are assigned to the other color-based pattern portions 402 to 40*x* respectively. In the second assigning process, the colors of the other color-based pattern portions 402 to 40$x$ are extracted by executing steps C8 and 08, steps C9 and C19, . . . or steps C17 and C27, based on the respective numbers n of stitches. The color extracted at any one of the steps C18 to C27 is stored in the extracted data storage area 249 and the counter i is incremented (steps C31 and C32) when the extracted color has a lower contrasting density than the color of the first color-based pattern portion having the smallest number n of stitches (YES at step C29) and does not overlap the previously extracted colors (YES at step C30). The control device 21 repeatedly executes the assigning process within the range of steps C7 to C32 until determining that the added number i of color-based pattern portions exceeds the total number x (NO at step C33). As a result, the colors assigned by the assigning process are stored in the extracted data storage area 249 so as not to overlap and so as to be associated with the respective color-based pattern portions 402 to 40$x$, whereupon the assigning process is completed and the control returns).

The control device 21 in the third example firstly extracts a color at random from the color group with the highest contrasting density (LV10) for the first color-based pattern portion 401 having the smallest number n of stitches and assigns the colors with the lower contrasting density than the firstly extracted color to the other color-based pattern portions 402 to 40$x$ (steps C3, C4, C7 and C29). Consequently, the color with the highest contrasting density out of the color-based pattern portions composing the embroidery pattern can reliably be assigned to the color-based pattern portion having the smallest number n of stitches.

The unit number $U_N$ ($U_N$=N/10) of stitches in the first example is obtained by dividing the total number N of the numbers $n_1$ to $n_x$ of stitches by the number of contrasting density level divisions (10, for example). Accordingly, when the smallest number $n_1$ of stitches is larger than the value of N/10, a color is not extracted from the color group with the highest contrasting density (LV10) with respect to the color-based pattern portion having the smallest number $n_1$ of stitches. On the contrary, the unit number $U_N$ of stitches in the third example is represented as a unit $((n_x-n_1)/10)$ that divides the stitch number range from $n_1$ to $n_x$ so that the number of divisions of the stitch number range corresponds with the number of divisions of the contrasting density. Accordingly, when the contrasting density is associated with the color-based pattern portion on the basis of the unit number $U_n$ of stitches (steps C8 to C17), the color can be extracted both from the color group with the highest contrasting density and from the color group with the lowest contrasting density. Consequently, while a random coloration is employed for the embroidery pattern, the color groups with the respective highest and lowest contrasting densities are normally assigned, whereupon a highly-attractive coloration can be carried out.

Other Examples

An area of each color-based pattern portion may be computed as the characteristic although the number n of stitches of each color-based pattern portion or the total number x of the color-based pattern portions is computed in the first to third examples. More specifically, the value of area of each color-based pattern portion is applied as the characteristic to the flowchart of FIGS. 9A and 9B in the first example. In this case, the control device 21 executes a process of computing an area of each one of the color-based pattern portions 401 to 40$x$ based on coordinate data of needle location data, for example, instead of step A2 in FIG. 9A. Furthermore, the control device 21 divides a total area of the color-based pattern portions by the number of divisions of the contrasting density levels (10, for example), thereby obtaining a unit area.

When "D" designates the value of area of each color-based pattern portion and "$U_D$" designates the value of a unit area, the control device 21 determines at step A6 whether or not the area D of each color-based pattern portion is not more than the unit area $U_D$. The control device 21 further determines at step A7 whether or not the area D of each color-based pattern portion is larger than the unit area $U_D$ and not more than $2U_D$. Thus, the control device 21 executes the process of associating the color with the data of the buffer-by-contrasting-density based on the unit area $U_D$, instead of steps A6 to A15. Since the area D and the number n of stitches have a correlation as described above, the same advantageous effect as in the first embodiment can be achieved in this case even when the assigning process is executed with the area D as the characteristic.

Figure 13:
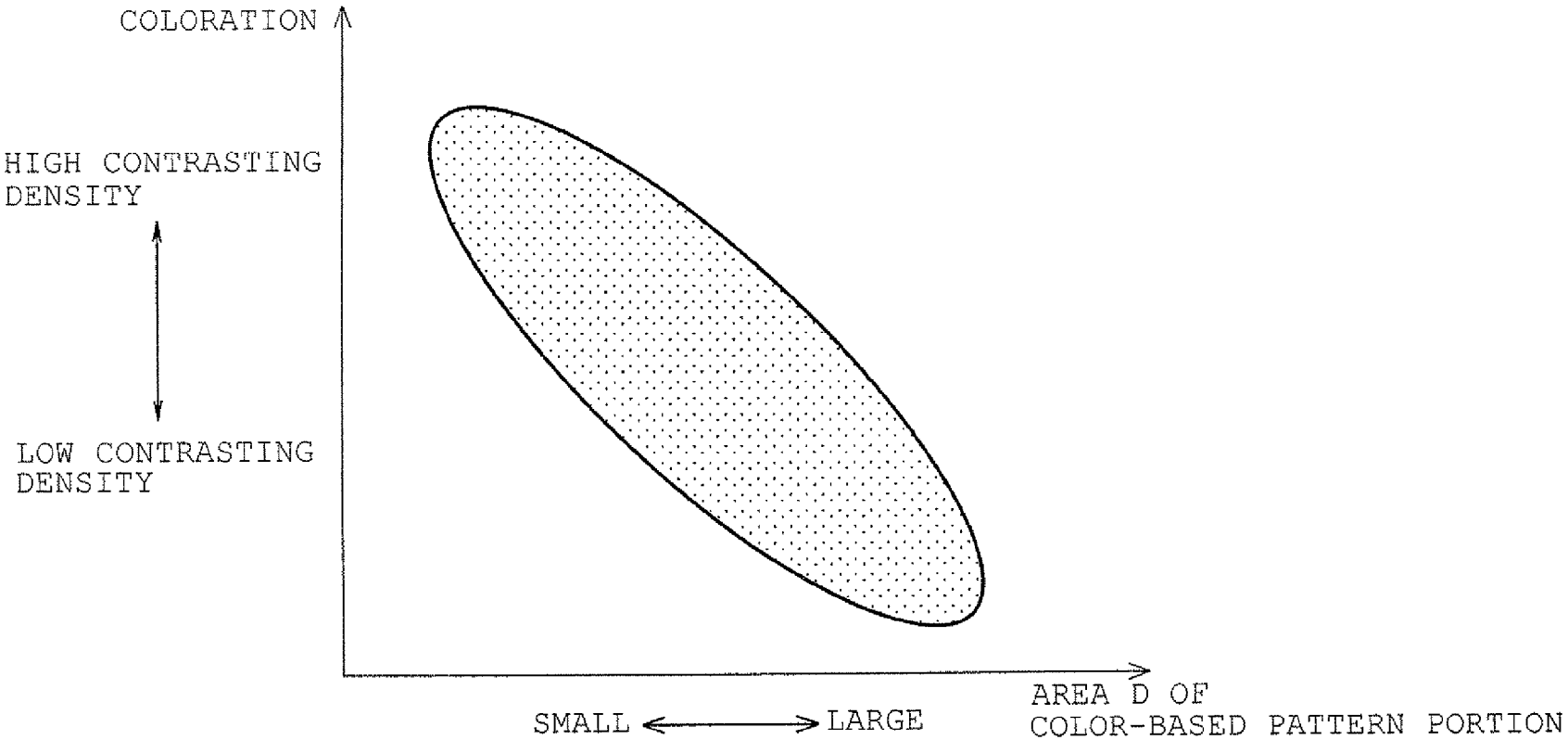
FIG. 13 is a graph showing the relationship between an area of different color pattern part and a contrasting density of color to be coordinated.

FIG. 13 schematically shows a relation between the area D and the contrasting density of the color to be assigned in the case where the assigning process is executed with the above-described area D as a characteristic. As shown, while the area D has a predetermined range of distribution because of a random coloration premised on the assigning process, a color with a lower contrasting density is assigned to the color-based pattern portion as the color-based pattern portion has a large area D, and a color with a higher contrasting density is assigned to the color-based pattern portion as the color-based pattern portion has a small area D.

Each area D is applied as a characteristic in the flowcharts of FIGS. 11A and 1113 in the second example. In this case, the control device 21 executes a process of computing an area D of each one of color-based pattern portions 401 to 40$x$ based on the needle location data, for example, instead of step B3 of FIG. 11A. Furthermore, the control device 21 executes a process of updating patterns 1 to x indicative of the sewing sequence i to a sewing sequence i' in which the color-based pattern portions 1 to x are re-arranged in the order of area D from the largest to the smallest, instead of step B4. When a plurality of color-based pattern portions has the same area, the control device 21 determines a sewing sequence according to the original sewing order i.

Furthermore, the control device 21 sets a counter i of the order of areas D to 1. The control device 21 then executes the assigning process to obtain the random coloration based on the sewing sequence i' in which the color-based pattern portions 1 to x are re-arranged in the order of area D from the largest to the smallest and the data of the buffer-by-contrasting-density, instead of steps B6 to B25. Consequently, colors can reliably be assigned from both groups of color intensities LV1 and LV10 and thus, the above-described configuration can achieve the same advantageous effects as the second example. Accordingly, a distribution range of the color to be assigned (a range surrounded by an ellipse shown in FIG. 13) can be enlarged vertically in the figure.

Each area D is applied as a characteristic in the flowcharts of FIGS. 12A-12C in the third example. In this case, the control device 21 executes a process of computing the area D of each of color-based pattern portions 401 to 40$x$ based on the needle location data, for example, instead of steps C2 in FIG. 12A. The control device 21 further executes a process of assigning the color extracted at step C3 to the color-based pattern portion having the smallest area D, instead of step C4. The control device 21 still further executes a process of subtracting the smallest one from the largest one of areas D and dividing the subtracted value by the number of contrasting density levels (10, for example) to thereby obtain a unit area (=(largest area−smallest area)/10).

At step C7 and subsequent steps, the control device 21 executes the assigning process in which the smallest number $n_1$ of stitches has been replaced by a smallest area, the largest number $n_x$ of stitches has been replaced by a largest area, and the unit number $U_N$ of stitches has been replaced by a unit area. Consequently, the same advantageous effects as those of the third example can be achieved from the above-described configuration. Accordingly, colors can be extracted from both group of colors with highest contrasting densities and group of colors with the lowest contrasting densities, and a distribution range of the color to be applied (a range surrounded by an ellipse as shown in FIG. 13) can be enlarged vertically in the figure.

The foregoing examples should not be restrictive but can be modified or expanded as follows. The embroidery data generator may not be provided on the sewing machine M. The embroidery data generator may include a device body that is a personal computer and may be a dedicated computer, a mouse, a keyboard, a memory card connector, a display all connected to the device body, and the like.

The memory should not be limited to the RAM 24 but may be an internal memory incorporated in the sewing machine or the embroidery data generator or an external memory detachably attached to the sewing machine or the embroidery data generator. When a sewing machine and an embroidery data generator are independent of each other as different from the foregoing example, the sewing machine and the embroidery data generator may be linked to each other by wired or wireless connections for data transmission and reception.

A storage medium which stores the embroidery data processing program should not be limited to the ROM 23 of the control device 21. Various storage medium such as a CD-ROM, a flexible disc, a DVD and the memory card 11 may be employed, instead. In this case, when data stored on each storage medium is read by the computer of the control device of the embroidery data generator to thereby be executed, the same advantageous effects as those achieved by the foregoing example can also be achieved.

The foregoing description and drawings are merely illustrative of the present disclosure and are not to be construed in a limiting sense. Various changes and modifications will become apparent to those of ordinary skill in the art. All such changes and modifications are seen to fall within the scope of the appended claims.

I claim:

1. A data generator comprising:

a memory configured to store a plurality of predetermined colors; and a processor configured to control the data generator to:

determine a characteristic of a color-based pattern portion, a plurality of the color-based pattern portions being included in an embroidery pattern; and assign a color, which being used as thread color data, for each of the plurality of color-based pattern portions based on the characteristic, the color being selected randomly from the plurality of predetermined colors stored in the memory, wherein determining the characteristic comprises determining at least one of an area and a number of stitches for the color-based pattern portion as the characteristic; and assigning the color comprises assigning the color based on the at least one of an area and a number of stitches for the color-based pattern portion.

2. The data generator according to claim 1, wherein the processor is further configured to control the data generator to:

allocate the plurality of predetermined colors to a plurality of groups, wherein assigning the color comprises assigning the color randomly selected from each of the plurality of groups for each of the plurality of color-based pattern portions.

3. The data generator according to claim 2, wherein allocating the plurality of predetermined colors comprises allocating the plurality of predetermined colors to the plurality of groups based on intensities of the plurality of predetermined colors, and assigning the color comprises:

assigning the color randomly selected from a group with smaller contrasting density of color among the plurality of groups as the at least one of an area and a number of stitches of a color-based pattern portions is larger; and assigning the color randomly selected from a group with larger contrasting density of color among the plurality of groups as the at least one of an area and a number of stitches of a color-based pattern portions is smaller.

4. A data generator comprising:

a memory configured to store a plurality of predetermined colors; and a processor configured to control the data generator to:

determine a characteristic of a color-based pattern portion a plurality of the color-based pattern portion being included in an embroidery pattern; and assign a color which being used as thread color data, for each of the plurality of color-based pattern portions based on the characteristic, the color being selected randomly from the plurality of predetermined colors stored in the memory, wherein determining the characteristic comprises determining a number of the color-based pattern portions as the characteristic, and assigning the color comprises assigning the color based on the number of the plurality of color-based pattern portions.

5. The data generator according to claim 4, wherein the processor is further configured to control the data generator to allocate the plurality of predetermined colors to a plurality of groups based on the number of the plurality of color-based pattern portions, and assigning the color comprises assigning the color randomly selected from each of the plurality of groups for each color-based pattern portion.

6. The data generator according to claim 5, wherein determining the characteristic further comprises determining at least one of an area and a number of stitches for the color-based pattern portion as a characteristic, allocating the plurality of predetermined colors comprises allocating the plurality of predetermined colors to the plurality of groups based on intensities of the plurality of predetermined colors, a number of the plurality of groups corresponds to a total number of the color-based pattern portions, and assigning the color comprises:

assigning the color randomly selected from a group with smaller contrasting density of color among the plurality of groups as the at least one of an area and a number of stitches of a color-based pattern portions is larger; and assigning the color randomly selected from a group with larger contrasting density of color among the plurality of groups as the at least one of an area and a number of stitches of a color-based pattern portions is smaller.

7. A non-transitory computer readable recording medium storing computer readable instructions that, when executed, cause a data generator to:

determine a characteristic of a color-based pattern portion, a plurality of color-based pattern portions being included in an embroidery pattern; and assign a color, which being used as thread color data, for each of the plurality of color-based pattern portions based on the characteristic, the color being selected randomly from a plurality of predetermined colors for each of the plurality of color-based pattern portions, wherein determining a characteristic of a color-based pattern portion comprises determining at least one of a number and an area of stitches for the color-based pattern portions as the characteristic; and assigning the color comprises assigning the color based on the at least one of an area and a number of stitches for each of the plurality of color-based pattern portions.

8. The non-transitory computer readable recording medium according to claim 7, wherein the instructions further cause the data generator to: allocate the plurality of predetermined colors to a plurality of groups, and assigning the color comprises assigning the color randomly selected from each of the plurality of groups for each of the plurality of color-based pattern portions.

9. The non-transitory computer readable recording medium according to claim 8, wherein allocating the plurality of predetermined colors comprises allocating the plurality of predetermined colors to the plurality of groups based on intensities of the plurality of predetermined colors, and assigning the color comprises:

assigning the color randomly selected from a group with smaller contrasting density of color among the plurality of groups as the at least one of an area and a number of stitches of a color-based pattern portions is larger; and assigning the color randomly selected from a group with larger contrasting density of color among the plurality of groups as the at least one of an area and a number of stitches of a color-based pattern portions is smaller.

10. A non-transitory computer readable recording medium storing computer readable instructions that, when executed, cause a data generator to:

determine a characteristic of a color-based pattern portion, a plurality of color-based pattern portions being included in an embroidery pattern: and assign a color, which being used as thread color data, for each of the plurality of color-based pattern portions based on the characteristic, the color being selected randomly from a plurality of predetermined colors for each of the plurality of color-based pattern portions, wherein determining the characteristic comprises determining a number of the plurality of color-based pattern portions as the characteristic, and assigning the color comprises assigning the color based on the number of the color-based pattern portions.

11. The non-transitory computer readable recording medium according to claim 10, wherein the instructions further cause the data generator to: allocate the plurality of predetermined colors to a plurality of groups based on the number of the plurality of color-based pattern portions, and assigning the color comprises assigning the color randomly selected from each of the plurality of groups for each of the color-based pattern portion.

12. The non-transitory computer readable recording medium according to claim 11, wherein determining the characteristic further comprises determining at least one of an area and a number of stitches for the color-based pattern portion as a characteristic, allocating the plurality of predetermined colors comprises allocating the plurality of predetermined colors to the plurality of groups based on intensities of the plurality of predetermined colors, a number of the plurality of groups corresponds to a total number of the color-based pattern portions, and assigning the color comprises:

assigning the color randomly selected from a group with smaller contrasting density of color among the plurality of groups as the at least one of an area and a number of stitches of a color-based pattern portions is larger; and assigning the color randomly selected from a group with larger contrasting density of color among the plurality of groups as the at least one of an area and a number of stitches of a color-based pattern portions is smaller.

13. A sewing machine comprising:

a memory configured to store a plurality of predetermined colors; and a data generator configured to generate embroidery data including thread color data which identify a color of a color-based pattern portion, a plurality of the color-based pattern portions being included in an embroidery pattern sewed by the sewing machine based on the embroidery data, the data generator comprising:

a processor configured to control the data generator to:

determine a characteristic of the color-based pattern portion; and assign a color, which being used as the thread color data, for each of the plurality of color-based pattern portions based on the characteristic, the color being randomly selected from the plurality of predetermined colors stored in the memory, wherein determining the characteristic comprises determining at least one of an area and a number of stitches for each color-based pattern portion and a number of the color-based pattern portions; and assigning the color comprises assigning the color based on any one of the determined area, the determined number of stitches and the determined number of the color-based pattern portions.

* * * * *